US012123114B2

(12) United States Patent
Bell et al.

(10) Patent No.: US 12,123,114 B2
(45) Date of Patent: Oct. 22, 2024

(54) WOVEN FOOTWEAR UPPER

(71) Applicant: NIKE, Inc., Beaverton, OR (US)

(72) Inventors: Thomas G. Bell, Portland, OR (US); Robert M. Bruce, Portland, OR (US); Yuchung Kevin Chen, Portland, OR (US); Yoon Jeong Choi, Portland, OR (US); Adam R. Farmer, Hillsboro, OR (US); Megan Foley, Portland, OR (US); Oliver McLachian, Beaverton, OR (US); James Y. Yoo, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 881 days.

(21) Appl. No.: 15/809,724

(22) Filed: Nov. 10, 2017

(65) Prior Publication Data

US 2018/0135213 A1 May 17, 2018

Related U.S. Application Data

(60) Provisional application No. 62/432,336, filed on Dec. 9, 2016, provisional application No. 62/420,982, filed on Nov. 11, 2016.

(51) Int. Cl.
*A43B 23/02* (2006.01)
*A43B 1/00* (2006.01)
(Continued)

(52) U.S. Cl.
CPC ..... *D03D 17/00* (2013.01); *A43B 1/0009* (2013.01); *A43B 23/0225* (2013.01);
(Continued)

(58) Field of Classification Search
CPC .... D03D 17/00; D03D 15/08; D03D 15/0027; D03D 13/004; D03D 15/04; D03D 9/00;
(Continued)

(56) References Cited

U.S. PATENT DOCUMENTS 760,205 A * 9/1904 Hickey ..... D03D 11/00 139/414
1,333,032 A * 3/1920 Migel ..... D03D 15/56 139/414
(Continued)

FOREIGN PATENT DOCUMENTS

EP 2862969 A1 4/2015
EP 2998423 A1 3/2016
(Continued)

OTHER PUBLICATIONS

International Preliminary Report on Patentability mailed May 23, 2019 in International Patent Application No. PCT/US2017/061322, 8 pages.
(Continued)

*Primary Examiner* — Katharine G Kane
(74) *Attorney, Agent, or Firm* — Shook, Hardy & Bacon L.L.P.

(57) ABSTRACT

Aspects of the present invention relate to a dynamic woven material that is capable of undergoing a dimensional change in response to an external stimulus. The dynamic woven material comprises a plurality of discrete woven cells, where each woven cell comprises a reactive region and a non-reactive region. The reactive region changes from a first physical state to a second physical state when the woven material is exposed to the external stimulus. The woven material may be formed with zonal stretch properties by varying the areas occupied by the reactive region and the non-reactive region in each woven cell. For example, the bigger the area occupied by the reactive region in the woven cells in a particular zone of the dynamic woven material, the higher the level of stretch in the particular zone may be. Exemplary products manufactured from the dynamic woven material include, for example, articles of footwear.

17 Claims, 11 Drawing Sheets

(51) Int. Cl.

| | |
|---|---|
| ***A43B 1/05*** | (2022.01) |
| ***D03D 1/00*** | (2006.01) |
| ***D03D 9/00*** | (2006.01) |
| ***D03D 13/00*** | (2006.01) |
| ***D03D 15/47*** | (2021.01) |
| ***D03D 15/56*** | (2021.01) |
| ***D03D 15/567*** | (2021.01) |
| ***D03D 17/00*** | (2006.01) |
| *A43B 1/04* | (2022.01) |
| *A43B 23/04* | (2006.01) |

(52) U.S. Cl.
CPC ..... *A43B 23/0245* (2013.01); *D03D 1/00* (2013.01); *D03D 9/00* (2013.01); *D03D 13/004* (2013.01); *D03D 15/47* (2021.01); *D03D 15/56* (2021.01); *D03D 15/567* (2021.01); *A43B 1/04* (2013.01); *A43B 1/05* (2022.01); *A43B 23/0205* (2013.01); *A43B 23/0265* (2013.01); *A43B 23/027* (2013.01); *A43B 23/042* (2013.01); *D10B 2331/04* (2013.01); *D10B 2331/10* (2013.01); *D10B 2501/043* (2013.01)

(58) Field of Classification Search
CPC .. D03D 1/00; D10B 2331/04; D10B 2331/10; D10B 2501/043; A43B 1/0009; A43B 23/0225; A43B 23/0245; A43B 23/0265; A43B 23/042; A43B 23/027; A43B 23/0205; A43B 1/04
USPC ..... 139/414
See application file for complete search history.

(56) References Cited

U.S. PATENT DOCUMENTS

| | | | | | |
|---|---|---|---|---|---|
| 2,335,642 | A * | 11/1943 | Butler | A47G 9/0207 | 139/426 R |
| 2,440,393 | A | 4/1948 | Clark | | |
| 3,699,958 | A * | 10/1972 | Szucs | A61L 15/46 | 604/304 |
| 4,815,499 | A * | 3/1989 | Johnson | D21F 1/0045 | 139/383 A |
| 5,098,756 | A * | 3/1992 | Henderson | A62B 17/001 | 220/88.1 |
| 8,800,606 | B2 * | 8/2014 | Cross | D03J 1/00 | 139/291 C |
| 2010/0248574 | A1 * | 9/2010 | King | D03D 15/04 | 442/205 |
| 2013/0186506 | A1 | 7/2013 | Cross et al. | | |
| 2014/0020786 | A1 * | 1/2014 | Usuki | D03D 1/0094 | 139/414 |
| 2014/0246113 | A1 * | 9/2014 | Sutton | D03D 15/0094 | 139/304 |
| 2016/0047072 | A1 * | 2/2016 | Tsai | D03D 15/04 | 139/410 |
| 2017/0066212 | A1 * | 3/2017 | de Backer | B29D 35/146 | |
| 2017/0067190 | A1 * | 3/2017 | Miyamae | D03D 1/00 | |

FOREIGN PATENT DOCUMENTS

| | | | |
|---|---|---|---|
| JP | 2-251427 | A | 10/1990 |
| TW | 201447064 | A | 12/2014 |
| WO | 2009/059596 | A1 | 5/2009 |

OTHER PUBLICATIONS

International Search Report and Written Opinion dated Feb. 21, 2018 in International Patent Application No. PCT/US2017/061322, 15 pages.

Office Action received for European Patent Application No. 17804771.8, mailed on Jul. 2, 2020, 5 pages.

Intention to Grant received for European Patent Application No. 17804771.8, mailed on Mar. 5, 2021, 8 pages.

* cited by examiner

WOVEN FOOTWEAR UPPER

CROSS-REFERENCE TO RELATED APPLICATION

This application claims priority to U.S. Provisional Application No. 62/420,982, entitled, "WOVEN FOOTWEAR UPPER," filed on Nov. 11, 2016, and U.S. Provisional Application No. 62/432,336, entitled, "WOVEN FOOTWEAR UPPER," filed on Dec. 9, 2016. The entireties of the aforementioned applications are incorporated by reference herein.

BACKGROUND

The manufacturing of a shoe upper may involve sewing and adhering a number of pieces and or upper portions to result in a three-dimensional volume able to receive a wearer's foot. The manufacturing resources utilized to cut and secure the individual pieces and/or upper portions can be costly and detrimental to the resulting quality of the shoe upper. However, even though the incorporation of multiple pieces may increase the burden on manufacturing resources, the various pieces and/or portions may be utilized in the manufacturing of shoe uppers to impart desired physical characteristics to the shoe uppers.

SUMMARY

Aspects of the present invention relate to a woven material having varied functional zones having varied degrees of stretch. The woven material may comprise a plurality of woven cells defined by their respective perimeters. Each woven cell in the plurality of woven cells may comprise one or more physically distinct regions enclosed within, wherein the physically distinct regions may comprise different physical, chemical, physicochemical properties, and the like, or in other words, may be reversibly or substantially irreversibly reactive in response to an external stimulus. Substantially irreversible as described herein may describe a physical and or chemical change where the material undergoing the change may not be fully returned to its original state (prior to being exposed to the external stimulus) by normal wear and tear, for example. For example, each woven cell in the plurality of woven cells may comprise two regions, namely a first region and a second region, where the amount of stretchability of each woven cell may be determined, in part, by the area occupied by each of the first region and the second region. In another example, each woven cell in the plurality of woven cells may comprise only a first region enclosed within, where the amount of stretchability of each woven cell may be determined, in part, by the area occupied by the first region in each respective woven cell. The area occupied by the first region (and the second region) in each woven cell may be varied at different locations in the woven material and consequently, the woven cells comprising, for example, a larger first region may be more stretchable than the woven cells comprising a smaller first region. In other words, the placement of the different woven cells on the woven material having the different stretchabilities provide the functional zones having varied degrees of stretch in the woven material. The woven material having varied functional zones having varied degrees of stretch may be manufactured as a rolled goods fabric/textile, or in the alternative, the woven material may be formed as a discrete piece of material according to the specifications of a final product (e.g., a footwear upper, an upper body garment, a lower body garment, a glove, a hat, and the like). For example, a footwear upper may be formed from a cut section (if formed as a rolled good) of the woven material with varied functional zones integrally formed therein. The varied functional zones may be strategically positioned zones having varied degrees of stretch that work to enhance a comfort of a wearer when the footwear article comprising the footwear upper formed from the woven material, is worn by a wearer. The footwear upper may start as a substantially planar upper that may undergo processing to be formed into a three-dimensional upper having a volume that may be occupied by a wearer's foot. Therefore, an upper having integrally formed functional zones may be formed in a single weaving operation that integrates the various functional zones in a common manufacturing process without utilizing post-processing coupling techniques to integrate the functional zones.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
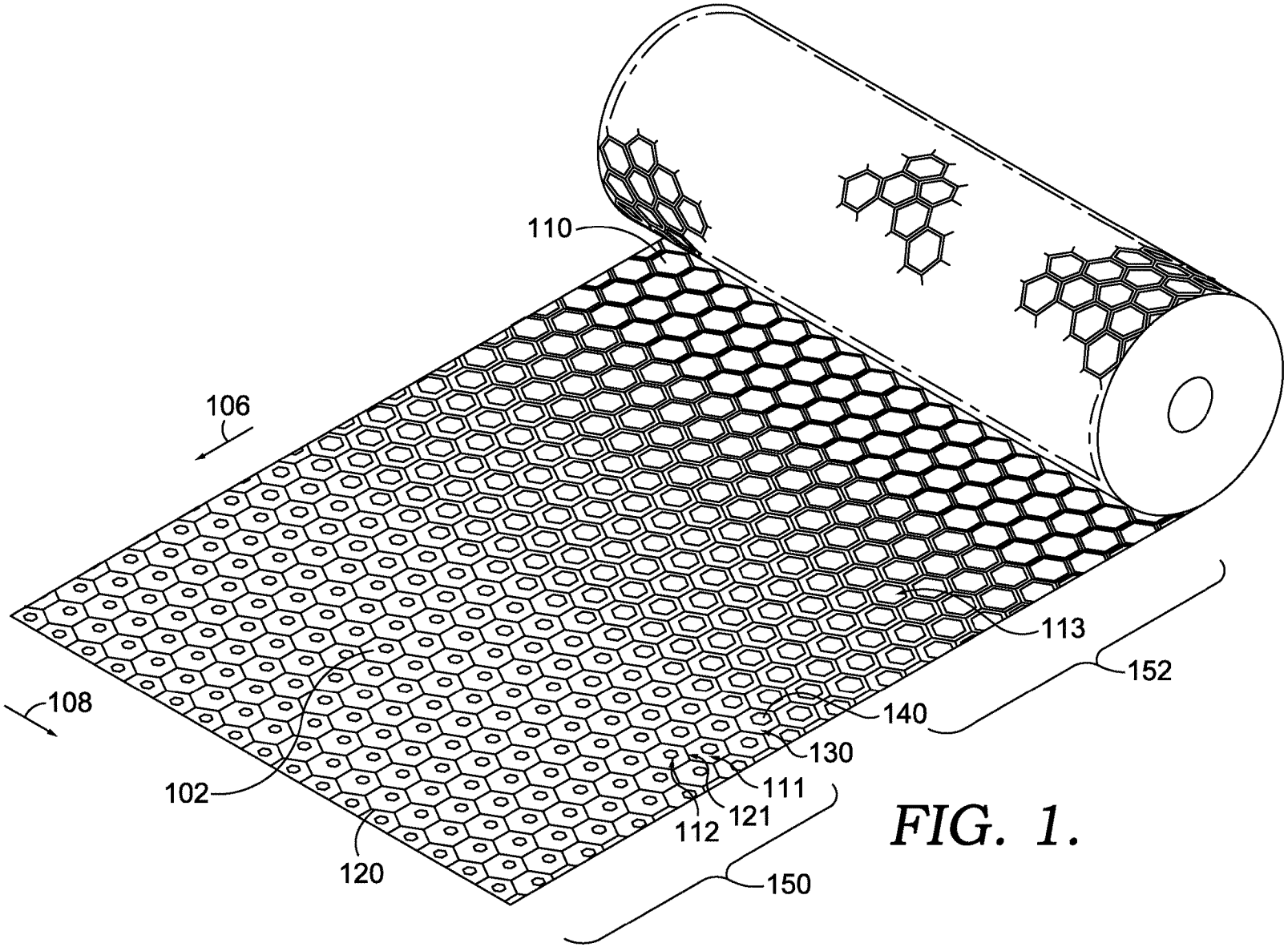
FIG. 1 depicts a roll good fabric/textile in accordance with aspects herein.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Aspects of the present invention relate to a woven material that comprises an inner surface and an outer surface. The woven material comprises a plurality of woven cells, each woven cell in the plurality of woven cells, at least when observed on the outer surface, comprises a perimeter comprising at least a first yarn, the perimeter defining an edge of each woven cell in the plurality of woven cells. Further, each woven cell in the plurality of woven cells may comprise a reactive region having at least a second yarn. In another example, each woven cell may comprise a reactive region having a second yarn and a non-reactive region having at least the first yarn. In accordance with an aspect herein, the perimeter and the non-reactive region may comprise a common composition and/or weaving pattern, as will become more apparent with respect to the discussion of the figures, below. The reactive and non-reactive regions are enclosed within the perimeter, where the reactive region may be configured to surround the non-reactive region if a non-reactive region is provided. In other words, the reactive region abuts the perimeter of the woven cell. The reactive region in each woven cell is configured to undergo a physical change from a first physical state to a second physical state when the woven material is exposed to an external stimulus. The non-reactive region, wen provided, is configured to remain unchanged when the woven material is exposed to the external stimulus.

The plurality of woven cells may form, for example, an array of nesting woven cells in the woven material. In other words, at least two woven cells may share at least a portion of the perimeter described above. For example, the woven cells may comprise, for example, a shape that is amenable for nesting. For example, geometric shapes with straight lines such as triangles, squares, rectangles, parallelograms, diamonds, hexagons, octagons, pentagons, are amenable for nesting, or in other words, forming a uniform array of the particular shape throughout a surface, with no irregular open gaps between shapes (i.e., for example, when laying tile on a surface, every tile is the same size and shape). Other desirable shapes may be for example, auxetic shapes such as, for example, an auxetic hexagon, which exhibits a negative Poisson's ratio. The auxetic shape may provide an additional dimensionality to the stretchability of the woven material described in accordance with aspects herein.

The woven material in accordance with aspects herein is capable of undergoing a physical deformation that gives the woven material unique stretch properties in at least the weft direction. The physical properties of the woven material may be achieved by the types of materials used to weave the woven material and the types of weaving patterns and/or techniques used to weave the woven material. In other words, the woven material may comprise multiple types of yarns, the particular properties of each type of yarn, along with the woven structures in the woven material (plurality of woven cells) may provide the woven material with different desirable properties. The yarns may be, for example, spun yarns and/or monofilament yarns according to their respective material composition, and/or texture. The different types of yarns may include a combination of synthetic materials (e.g., polyester, rayon, nylon, thermoplastics such as thermoplastic polyurethane, elastomers or elastic materials such as elastane, rubber, and the like), a combination of synthetic materials with natural materials, only natural materials (e.g. cotton, hemp, silk, etc.), and the like. The different yarns may be interwoven with each other to form the plurality of woven cells in the woven material in accordance with aspects herein. For purposes herein, the materials used for weaving are described as yarns, yarns are contemplated to include threads, strings, cords, monofilaments, and the like. Additionally, the yarns in accordance with aspects herein may comprise fibers or filaments that are twisted, braided, spun, melt spun, tangled, and the like, without departing from the aspects described herein. Furthermore, the yarns in accordance with aspects herein may comprise a single material, or in the alternative, the yarns may be multi-component yarns formed from two or more synthetic, natural, or both synthetic and natural materials.

In an exemplary aspect, the warp yarns in the woven material may be comprised of, for example, polyester yarns having a weight in denier (D=grams/9000 meters) between 50 D-600 D, 100 D-570 D, 110 D-450 D, 130 D-330 D, 140 D-200 D, 150 D-180 D, and the like. The warp yarns are present throughout the length of the woven material, whether the woven material is woven as a discrete garment panel, a footwear panel, and the like, or whether the woven material is woven as a roll goods (i.e. X meters of the fabric/textile per roll). The weft yarns in the woven material may comprise different types of yarns, whose compositions may play a role in the special properties of the woven material. The weft yarns are present throughout the width of the woven material and may comprise, for example, thermoplastic polyurethane (TPU) coated polyester yarns, silicone coated polyester yarns, rubber coated polyester yarns, elastomer yarns (e.g., elastane, synthetic rubbers (e.g., silicone rubber, polyacrylic rubber), natural rubber (e.g., gum)), yarns comprising different degrees of aramid fibers (e.g., Kevlar®), coated nylon yarns similar to the above described polyester yarns, and the like. The yarns described above are merely exemplary and it is contemplated that the yarns in accordance with aspects herein may comprise different compositions than the ones described above. For example, it is contemplated that the yarns may be monofilament or multi-component yarns comprising different types of materials than the ones described above. The choice of materials may differ according to the specific properties desired in the final woven fabric/textile. Since there is greater flexibility in the weft direction in a weaving process, the weft yarns may be used to introduce different properties into the woven fabric/textile based on need, visual appeal, inherent properties, surface exposure, texture, resilience, elasticity, and the like, for the final woven product/material. However, it is also contemplated that the warp yarns may also be used to impart different properties to the woven material in the warp direction.

For example, the woven material in accordance with aspects herein may comprise a first weft yarn such as, for example, a polyester yarn having a weight in denier between 200 D-400 D, 220 D-380 D, 240 D-360 D, 260 D-340 D, 280 D-340 D, 300 D-320 D. The woven material may further comprise a second weft yarn such as, for example, a TPU coated polyester yarn having a weight in denier between 300 D-700 D, 350 D-650 D, 400 D-600 D, 450 D-550 D. Furthermore, the woven material may comprise a third weft yarn such as, for example, a covered elastic yarn (having a core of an elastic material and a cover of, for example, polyester, e.g. elastane) having a weight in denier for the elastic core between 50 D-300 D, 60 D-290 D, 70 D-280 D, 80 D-270 D, 90 D-260 D, 100 D-250 D, 110 D-240 D, 120 D-230 D, 130 D-220 D, 140 D-280 D, 140 D-250 D.

The first, second, and third weft yarns may impart different properties to the woven material and more specifically, to each woven cell in the woven material. For example, the first weft yarn may provide dimensional sturdiness (i.e., lock-down) of each woven cell within the plurality of woven cells, the second weft yarn may provide, for example, abrasion resistance to the woven material, and the third weft yarn may provide stretchability/elasticity to the woven material. Furthermore, the technique in which each of the different yarns are integrated to form, for example, a single layer, multiple layers, voided areas, and the like, may also impart different properties to the woven material. For example, a woven material generally having at least a first surface and a second surface, may be woven to expose certain materials (i.e., yarns) in the first surface, and different materials in the second surface, at different sections/areas/portions of the final woven material (i.e., woven fabric/textile or woven form such as for example, a footwear upper).

Additionally or alternatively, one or more of at least the first, second, and third weft yarns may be sensitive to an external stimulus, such as, for example, temperature, causing the yarn to undergo one or more of a physical change, a chemical change, or both a physical and a chemical change when exposed to the external stimulus. Exemplary external stimuli may include, for example, temperature, pressure, moisture, and the like. For example, if a yarn is temperature sensitive, the yarn(s) may be sensitive to a particular temperature range where when exposed to the particular temperature range, may undergo a physical, chemical, or physicochemical change in response to the particular temperature range. In other words, the yarn(s) may comprise a threshold temperature where the yarn(s) is in a first physical, chemical, or physicochemical state below such threshold temperature, and may be induced to move into a second physical, chemical, or physicochemical state when exposed to temperatures that are equal to or close to the threshold temperature (i.e. there may be a ±15° C. margin, ±10° C. margin, a ±5° C. margin, and the like). Depending on the material composition of the yarns used in weaving the woven material, the threshold temperature may range between, for example, 100° C.-150° C., 105° C.-145° C., 110° C.-140° C., 115° C.-135° C., 120° C.-130° C., and 125° C.-135° C. In an exemplary construction, the woven material may be exposed to a steaming process at a temperature between 100° C. and 150° C. The 150° C. upper range, in an exemplary aspect, is limited to maintain a physical and chemical integrity of one or more of the contemplated materials (i.e., yarns) that are considered to be more stable and/or non-reactive when exposed to the external stimulus, when compared to the sensitive materials (i.e., yarns). Therefore, the range of temperature may allow for the thermoprocessing of the intended materials without inducing an unintended degradation of the material not intended to be thermoprocessed, in an exemplary aspect.

The physical, chemical, or physicochemical change may be a reversible or a substantially irreversible change (i.e., the change may be between about 49%-0%, reversible, 40% reversible, 35% reversible, 30% reversible 25% reversible, 20% reversible, 15% reversible, 10% reversible, 5% reversible, etc.) from a first state to a second state. When the change is irreversible, the yarn may remain in its second state irrespective of subsequent processing (e.g., even when exposed to a similar or a different external stimulus). When the change is reversible, the yarn may be returned to the first state from the second state in response to time, a second external stimulus such as moisture (e.g. by washing), and the like. In accordance with aspects herein, a weft yarn capable of undergoing a physical change in response to an external stimulus may be provided in the woven fabric/textile. The weft yarn may, for example, be a temperature sensitive yarn that is dimensionally unstable at or above a particular threshold temperature. For example, the threshold temperature may be between 100° C. and 150° C. and therefore, when exposed to the threshold temperature (e.g. 120° C., 115° C., 100° C., 137° C., and the like), a length of the weft yarn may be irreversibly reduced from a first length to a second length. In other words, the weft yarn may become physically shorter when exposed to the particular threshold temperature. This irreversible physical change in the yarn may be used to provide unique three dimensional characteristics (i.e., texture (e.g., z-directional change in a substantially planar good)) to the fabric/textile in accordance with aspects herein that will become more apparent in the description provided below with reference to the figures.

It is contemplated that any type and combination of manufacturing techniques may be implemented in exemplary aspects. For example, it is contemplated that a substantially fabric/textile may be formed as a roll good or a substantially planar upper for an article of footwear may be formed in a loom that is functional to alternate different material yarns and weaving techniques utilized in one or more regions. Similarly, it is contemplated that a knitting machine may be implemented to form a substantially planar material, as provided herein.

Traditionally, weaving utilizes two distinct directional sets of yarns/threads/fibers/filaments that are interlaced orthogonally to one another to form the resulting fabric/textile. For example, a first directional set running in a first direction of the resulting fabric may be referred to as a warp set, or "warps" for short. Interlaced at a right angle to the warps are a second directional set, referred to as a weft set, or "wefts" for short. Stated differently, longitudinal elements (e.g., threads, yarn, fibers, and filaments) of a woven article are the warp and the lateral elements are the weft.

Depending on a number of factors, characteristics of the resulting fabric may be affected. Those characteristics may include, but are not limited to, the fabric's size, shape, feel, look, texture, impact absorption/attenuation/response, moisture repellency/wicking, thermal energy insulation/dissipation, stretchability, and the like. Factors that are contemplated as affecting the characteristics include, but are not limited to how the warp and weft are interwoven. Additionally, depending on the size of the elements utilized in the warp and/or the weft relative to other warp and/or weft affect the resulting fabric characteristics. The type of material from which individual (or sets) of elements are formed (e.g., twisted fibers, synthetic filaments, multi-material filaments, and the like) also may affect the characteristics. Reactions and other in-line and post-processing activities (e.g., introduction of stimulus to a reactive material or portion of material) may affect the resulting characteristics of the fabric. Other variables that are manipulated during the weaving process may also affect the resulting characteristics (e.g., tension, loom type, loom characteristics, temperature, and the like). The formation of a woven product, such as a roll good, or an upper for an article of footwear, may occur on a loom-like device. In an exemplary aspect, the loom holds the warp threads in place as weft threads are interlaced in a repeating or non-repeating manner. It is also contemplated that other devices may be implemented other than a traditional loom to form a woven product. For example, tablet weaving, back-strapping, and other techniques are contemplated.

As will be discussed and described in more detail hereinafter, it is possible to implement any number of weaving techniques. In a plain weave, the warp and weft are aligned so they form a simple criss-cross pattern, which may be balanced so that there are the same number of ends per inch (i.e., warps) and picks per inch (i.e., wefts). Another example weaving pattern that is contemplated herein is a twill weave. In a twill weave, a pattern of diagonal parallel ribs (also referred to as a wale) may be visible. The ribs are formed by passing the weft over one or more warps and then under two or more warps. The following row of wefts then are offset by one or more warps from the previous row providing a stepping pattern. Additionally, a satin weave is contemplated. A satin weave may have four or more wefts floating over a single warp or vice versa. The type of woven process employed is not limited to plain, twill, or satin, but instead they are merely exemplary in nature and may form a building block from which the ultimate weaving process is selected.

In addition to traditional weaving techniques, it is also contemplated that a dobby, jacquard, or other mechanism may be implemented for manipulating heddles or harness (es) controlling the position of one or more warps to form the resulting woven article. Therefore, any combination of weaving techniques may be implemented.

In the alternative of weaving, it is also contemplated that a substantially planar upper may be formed utilizing a knitting technique. A knit article, such as a shoe upper, is an article formed, in an exemplary aspect, through a method of integrating consecutive rows of loops (e.g., stitches) with a subsequent row of loops. A new loop in a subsequent row is pulled through an existing loop of a previous row, in an example. In knitting a yarn/fiber/thread/filament follows a course forming the symmetric loops (i.e., bights) symmetrically above and below the mean path of the yarn. A variety of stitches (e.g., knit or purl, slip-stitch fair-isle, drop-stitch) may be implemented to provide various functionality (e.g., elasticity), dimensional effects (e.g., ribbing, welting, basket weaving) and aesthetic results. Any combination of materials and stitching techniques may be implemented in one or more aspects herein.

A single spun yarn may be knitted as is, or it may be braided or plied with another yarn. In plying, two or more yarns are spun together. When spun together, a direction of spinning may be opposite from which the yarns were originally spun (if at all); for example, two Z-twist yarns may be plied with an S-twist. The opposing twist may relieve some of the yarns' tendency to curl up and produces a thicker, balanced yarn. Plied yarns may themselves be plied together, producing cabled yarns or multi-stranded yarns. Sometimes, the yarns being plied are fed at different rates, so that one yarn loops around the other, as in bouclé.

Referring now to the figures, an exemplary aspect is a woven substantially planar roll good fabric/textile 100 with warps running in the warp direction 106 and wefts running perpendicular to the warps in a weft direction 108, as shown in FIG. 1, that is comprised of a plurality of woven cells 110, each woven cell in the plurality of woven cells 110 is defined by a perimeter 120 where a first woven cell 111 and a second woven cell 112 in the plurality of woven cells 110 share at least one common portion 121 of the perimeter 120. Further, each woven cell in the plurality of woven cells may comprise one or more physically distinct regions. For example, each woven cell in the plurality of woven cells 110 comprises a reactive region 130 and a non-reactive region 140, the non-reactive region 140 being enclosed within the reactive region 130, in an exemplary aspect. However, it is also contemplated that in other exemplary aspects, only a reactive region may be present (as shown and discussed below with reference to FIGS. 16-18,) or the reactive region may be enclosed within a non-reactive region, or the reactive region and non-reactive region may be presented in neighboring cells, or side by side in the same cell, or zonally in the weft direction, or zonally in the warp direction in the woven fabric/textile. Furthermore, although the examples presented herein discuss cells substantially enclosed within a perimeter, it may be envisioned that the transition between a reactive region and non-reactive region may be more organic (e.g., without delineated borders marking a particular shape, such as, with the perimeters). The reactive region 130 and the non-reactive region 140 may be uniformly distributed in each woven cell of the plurality of woven cells 110. In the alternative, a first woven cell 111 in a first area 150 of the roll good fabric/textile 100 may comprise a reactive region 130 that is larger than a different woven cell 113 in a second area 152 of the roll good fabric/textile. The change in proportions of the reactive region 130 and the non-reactive region 140 may be gradual (i.e. creating a gradient) from a first end 160 of the roll good fabric/textile 100, to a second end 170 of the roll good fabric/textile 100, as shown in FIG. 2.

Figure 2:
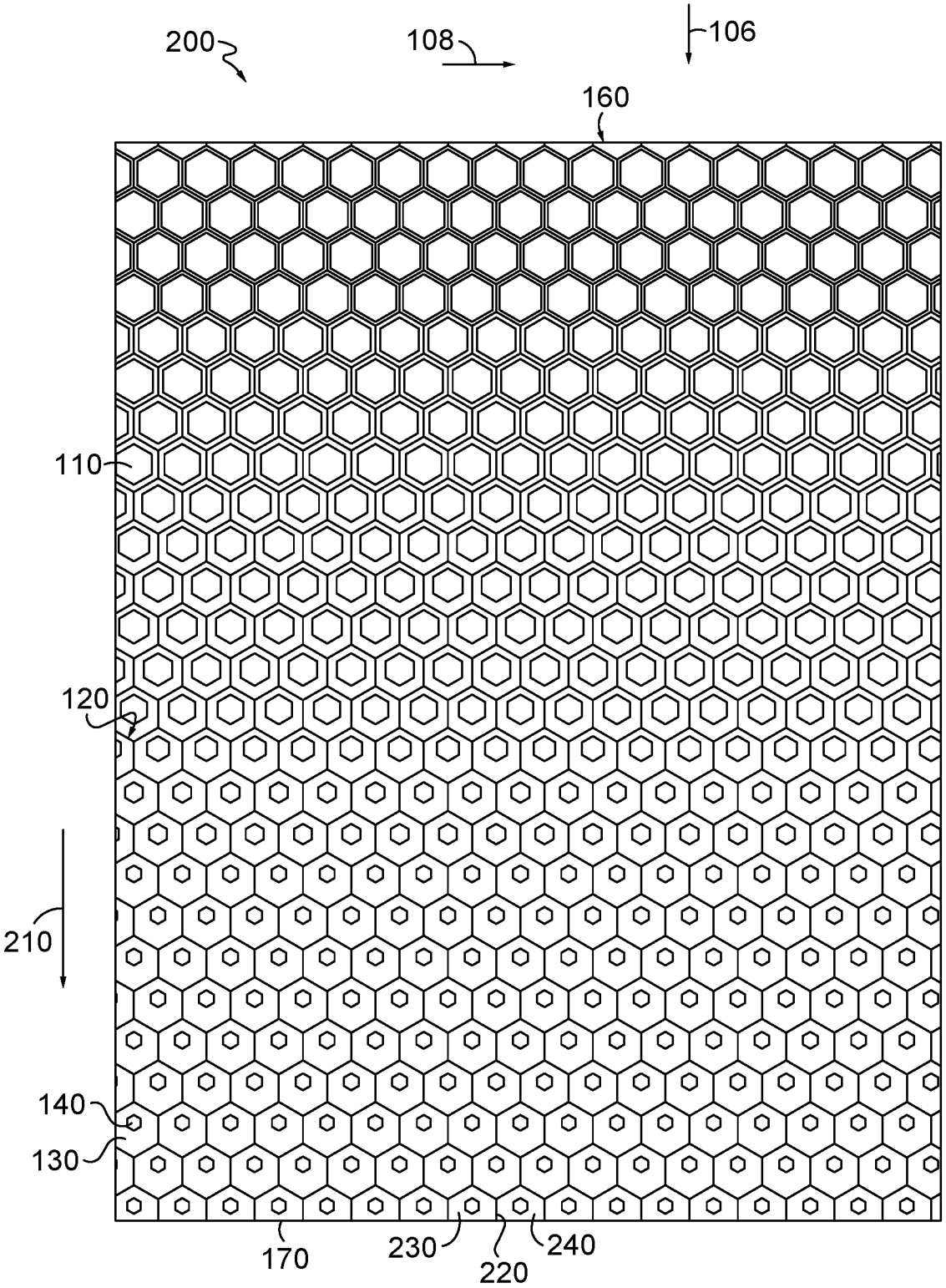
FIG. 2 depicts a fabric/textile section cut out from the roll good fabric/textile depicted in FIG. 1, in accordance with aspects herein.

Moving on to FIG. 2, a two dimensional view of a piece of fabric/textile 200 cut out from the roll good fabric/textile 100 is shown. It is more clearly seen in FIG. 2, that each woven cell in the plurality of woven cells 110 may be the same size shape (in this case hexagonal shape) and may be defined by a perimeter 120, wherein two adjacent woven cells in the plurality of woven cells 110 share a common portion of the perimeter 120. For example, a first woven cell 230 and a second woven cell 240, share common portion 220 of the perimeter 120. Further, as better depicted in FIG. 2, an area occupied by the non-reactive region 140, is gradually decreased from a first end 160 to a second end 170, thereby creating a gradient 210 in the warp direction 106, however, although not shown, the gradient may also be created in the weft direction 108, without departing from aspects in accordance herein. It is also contemplated that instead of a gradient 210, the non-reactive region 140 may occupy a uniform area in each woven cell in the plurality of woven cells 110, or alternatively, the gradient 210 may be less gradual an more zonal (i.e. having a first zone with a first portion of woven cells in the plurality of woven cells 110 having a first area occupied by the non-reactive region 140, a second zone with a second portion of woven cells in the plurality of woven cells 110 having a second different relatively sized area occupied by the non-reactive region 140, a third zone with a third portion of woven cells in the plurality of woven cells 110 having a third yet different relatively sized area occupied by the non-reactive region 140, and so on). Additionally, or alternatively, the area occupied in each woven cell in the plurality of woven cells 110 by the non-reactive region 140 may be varied according to a particular pattern, or design formation, or a combination of a gradient 210 and a design formation. Any and all variations in the area occupied by the non-reactive region 140 in each woven cell in the plurality of woven cells 110 are possible, without departing from aspects in accordance herein.

Figure 3:
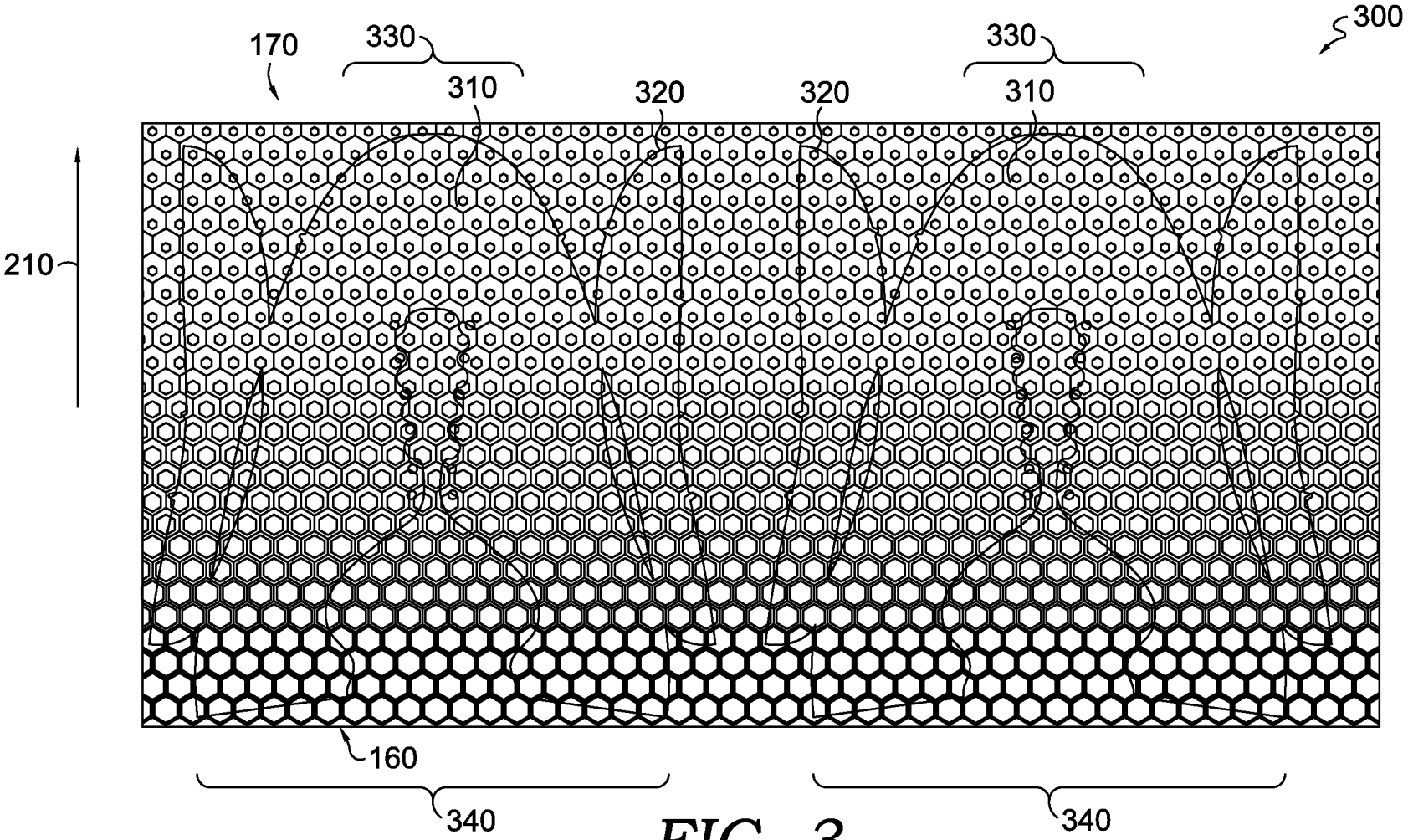
FIG. 3 depicts the fabric section in FIG. 2, with one or more upper form outlines indicated on the fabric/textile section in accordance with aspects herein.

When the fabric/textile is woven as continuous material and formed as a roll good fabric/textile 100 as shown in FIG. 1, multiple pieces may be cut out from it to form a desired final product. For example, as shown in FIG. 3, multiple woven footwear upper forms 310 may be formed from a roll good fabric/textile 100 and/or fabric/textile piece 300 cut or severed from the roll good fabric/textile 100. In the non-limiting particular example shown in FIG. 3, the fabric/textile piece 300 comprises two exemplary outlines 320 of two woven footwear upper forms 310.

As further depicted in FIG. 3, the outlines 320 for the woven footwear upper forms 310 are provided in such a way that the heel ends 340 of the woven footwear upper forms 310 are located near the first end 160 of the fabric/textile piece 300 and the toe ends 330 of the woven footwear upper forms 310 are located near the second end 170 of the fabric/textile piece 300. This particular orientation placing the gradient 210 for the non-reactive region 140 from largest at the heel ends 340 of the woven footwear upper forms 310 and the smallest at the toe ends 330 of the woven footwear upper forms 310 may for example, form a functionally appropriate footwear upper having varied characteristics in the footwear upper that are introduced by the gradient configuration described herein. The specific characteristics of the orientation, as described above in this particular example, will become more apparent in the description below with reference to FIGS. 4-7.

Figure 4:
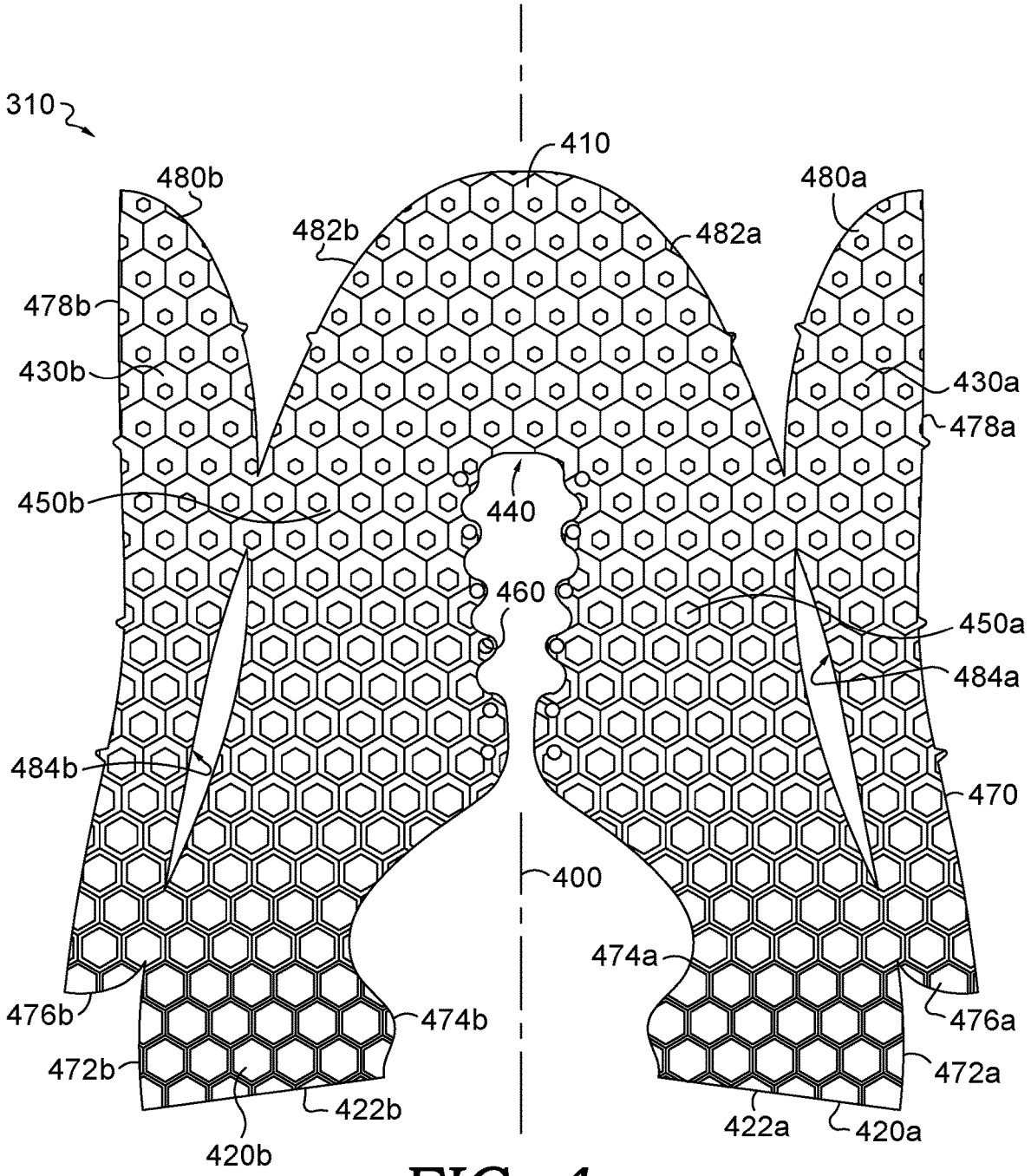
FIG. 4 depicts an upper form cut out from the fabric/textile piece according to the upper form outline(s) depicted in FIG. 3 in accordance with aspects herein.

As shown in FIG. 4, the woven footwear upper forms 310 may be cut out from the piece of fabric/textile piece 300 shown in FIG. 3 by, for example, die cutting, manual cutting (i.e. with scissors, knife, and the like), laser cutting, trimming, sheering, etching, burning, melting, and other known techniques. Employing a high temperature method for cutting the woven footwear upper forms 310, such as laser cutting, may be advantageous to seal an edge or perimeter 470 where the sealed edge or perimeter 470 may be formed simultaneously when cutting around the outlines 320 of each woven footwear upper form 310. The perimeter 470, once sealed, may prevent any loose strands from the woven fabric/textile of the woven footwear upper form 310 from unraveling, making it easier to handle in subsequent processing steps. In a different example, the perimeter 470 may be optionally constructed having different characteristics than other portions/regions of the woven footwear upper form 310. For example, it is contemplated that the perimeter 470 may be formed as a multi-layer density weave region. The perimeter 470 may have a relatively low modulus of elasticity compared to other regions of the woven footwear upper form 310. Additionally, the perimeter 470 may have multiple layers for reinforcement against ripping, tearing, unraveling, and other potentially destructive characteristics. In an exemplary aspect, the perimeter 470 may be formed with a high density weaving technique that may incorporate varied materials (e.g., low stretch synthetic fibers). Additionally, it is contemplated that the perimeter 470 may be formed with a multi-layer weaving technique. Because the perimeter 470 may be a region in which mechanical fastening (e.g., sewing, bonding, tacking, and the like) may be implemented to transform the woven footwear upper form 310 to a three dimensional footwear upper, the enhanced resistance to deformation may be implemented.

FIG. 4 further shows a woven footwear upper form 310 cut out from, for example, the fabric/textile piece 300 depicted in FIG. 3 in a substantially planar orientation. It is contemplated that the woven footwear upper form 310 may also be formed, as an integrally manufactured article. The term "substantially planar" means the woven footwear upper form 310 is not formed into a foot-receiving form having an interior volume into which a foot may be inserted. "Substantially planar" does not imply a lack in thickness or depth variation. To the contrary, a substantially planar woven footwear upper form 310 is contemplated to have different dimensional regions within the substantially planar woven footwear upper form 310. A typical knit or woven article as it comes off of a manufacturing machine (e.g., loom machine) may be in a sheet-like form, with the exception of three-dimensional knitting and weaving techniques. While these articles are in a sheet-like state, they may have variations to thickness based on differences in material utilized and/or techniques implemented. Therefore, a substantially planar article may include a sheet-like article having dimensional thickness variations, in an exemplary aspect.

The woven footwear upper form 310 is substantially planar and comprised of a plurality of functionally varied regions. Stated differently, the woven footwear upper 310 may be formed from a common machine that utilizes varying techniques to impart the functional regions and dimensional characteristics. This is in contrast to a typical shoe construction that requires a plurality of subsequent manufacturing processes to couple one or more components to an underlying substrate to achieve varied functional zones. For example, a cut and sew (or bond) approach may be utilized in a typical upper construction where multiple cut pieces are mechanically connected with sewing and/or adhesives in a series of events. Advantages of a woven footwear upper in accordance with aspects herein over traditional shoe manufacturing processes, may include, for example: reduced labor, reduced time, greater versatility, greater quality control, and the like.

While the terms "medial" and "lateral" will be used herein for purposes of convenience, it is intended and understood that each term could be substituted for the other term. Or, in the alternative, it is understood that generic terms, such as "first" and "second" could be substituted for either medial or lateral. This substitution is, in part, to allow for a right article of footwear construction and a left article of footwear construction. Similarly, it is contemplated that some portions of the woven footwear upper form 310 may alternatively be coupled (either integrally or mechanically) to an opposite side (e.g., the heel portion 420*a* may be integrally coupled with the medial side portion 450*a* and the heel portion 420*b* may be integrally coupled with the lateral side portion 450*b*, in an exemplary aspect).

Starting at the bottom leftmost portion of FIG. 4, the woven footwear upper form 310 is comprised of a lateral heel edge 422*b*. The lateral heel edge 422*b* may be formed to be mechanically coupled with a medial heel edge 422*a* to form a three-dimensional upper. The lateral heel edge 422*b* is a portion of the woven footwear upper form 310 perimeter 470. The lateral heel edge 422*b* extends from a lateral lower heel edge 472*b* of the perimeter 470 to an ankle edge 474*b* of the perimeter 470. Similarly, the medial heel edge 422*a* extends from a medial lower heel edge 472*a* of the perimeter 470 to an ankle edge 474*a* of the perimeter 470, in an exemplary aspect.

Continuing on from the lateral lower heel edge 472*b*, the perimeter extends to a lateral heel flap edge 476*b*. The lateral heel flap edge 476*b* merges into a lateral flap edge 478*b* in the toewardly direction. The lateral flap edge 478*b* forms into the lateral toe flap edge 480*b*. In combination the lateral heel flap edge 476*b*, the lateral flap edge 478*b*, and the lateral toe flap edge 480*b*, in part, define a lateral sole flap 430*b*. The lateral sole flap 430*b*, in an exemplary aspect, may be coupled with an opposite medial sole flap 430*a* along the lateral flap edge 478*b* to form a bottom portion of the interior 903 of the article of footwear 900 (shown in FIG. 9). Stated differently, the lateral sole flap 430*b* and the medial sole flap 430*a* may be mechanically coupled to form, in part, a bottom surface of a three dimensional volume, as will be illustrated in FIG. 9 hereinafter.

Similarly, it is contemplated that the lateral heel flap edge 476*b* may be coupled with the lateral lower heel edge 472*b* to also form, in part, a three-dimensional volume of the interior 903. Further, it is contemplated that the lateral toe flap edge 480*b* and a lateral toe edge 482*b* may be coupled to also form, in part, a three-dimensional volume of the interior 903. In a post-processing step, the corresponding edges in the woven footwear upper 310 may be mechanically coupled (e.g., sewn, sealed, bonded, adhered) together to form a three-dimensional volume.

The lateral toe edge 482*b* extends toewardly from the lateral toe flap edge 480*b* intersection around the toe box 410 as part of the perimeter 470. The lateral toe edge 482*b* merges into a medial toe edge 482*a*. Together, the medial toe edge 482*a* and the lateral toe edge 482*b* form a toe edge defining a perimeter of the toe box 410.

The medial toe edge 482*a* intersects a medial toe flap edge 480*a*. The medial toe flap edge 480*a* intersects with the medial flap edge 478*a*, which extends heelwardly to a medial heel flap edge 476*a*. The medial flap edge 478*a* was previously discussed as a coupling edge in connection with the lateral flap edge 478*b*. The medial heel flap edge 476*a* merges into the medial lower heel edge 472*a*, which was previously discussed as being formed in complement to the lateral lower heel edge 472*b*. Together the medial toe flap edge 480*a*, the medial flap edge 478*a*, and the medial heel flap edge 476*a* define, at least in part, a perimeter of the medial sole flap 430*a*. The medial toe flap edge 480*a* and the medial toe edge 482*a* are contemplated as being coupled, in part, to form the three-dimensional volume from the woven footwear upper form 310. Similarly, it is contemplated that the medial heel flap edge 476*a* and the medial lower heel edge 472*a* are contemplated as being coupled, in part, to form the three-dimensional volume from the woven footwear upper form 310. As previously discussed, the medial sole flap 430*a* and the lateral sole flap 430*b* may be coupled to form a lower portion (e.g., sole-like surface) from the woven footwear upper form 310 when in a three-dimensional configuration, as illustrated in FIG. 5 hereinafter.

Figure 9:
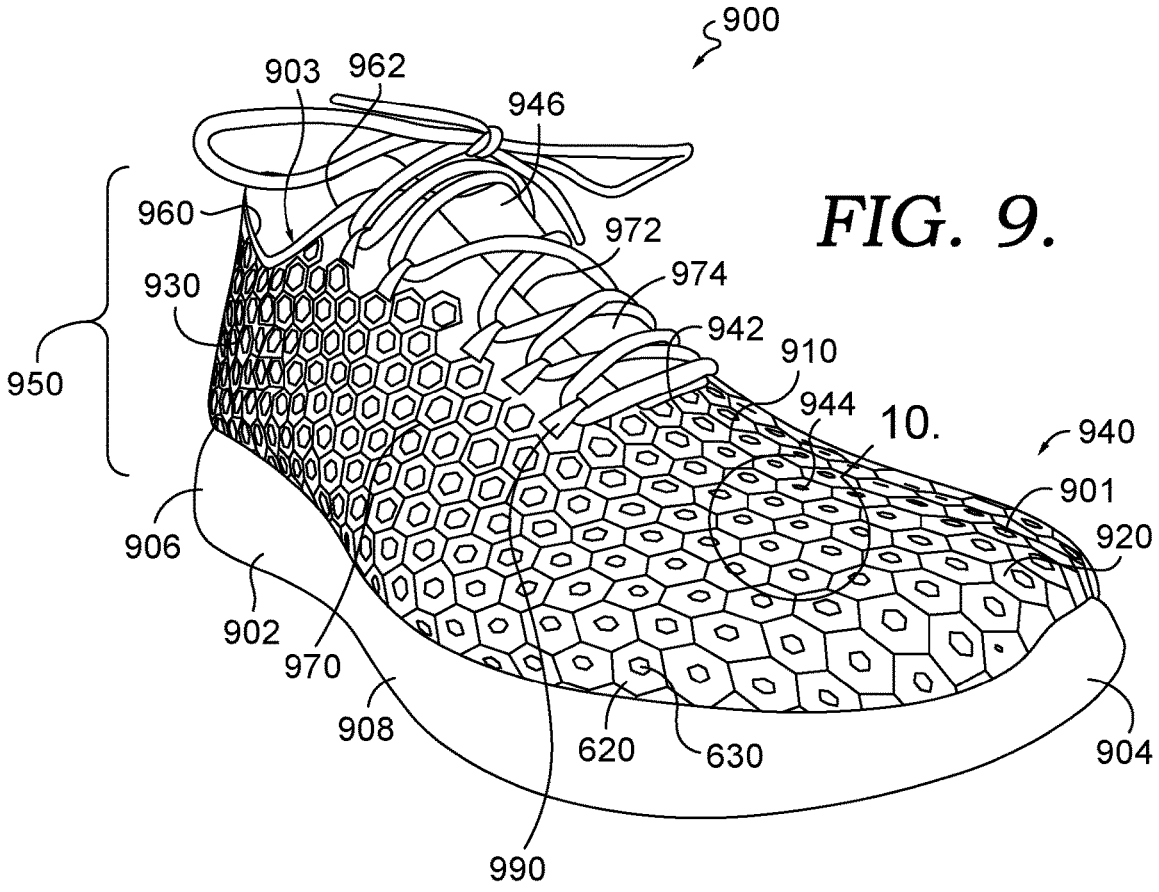
FIG. 9 depicts a perspective view of an article of footwear comprised of a zonal stretch upper in an as-worn configuration, in accordance with aspects herein.

In an exemplary aspect, it is contemplated that the medial sole flap 430*a* and the lateral sole flap 430*b* are mechanically coupled with the sole 902 of FIG. 9. For example, it is contemplated that the upper 901 formed from the woven footwear upper form 310 is coupled with the sole 902, at least in part by way of the medial sole flap 430*a* and the lateral sole flap 430*b*. It is also contemplated that the medial sole flap 430*a* and the lateral sole flap 430*b* may be positioned between an insole inserted into the interior 903 of the article of footwear 900 and the top surface of the sole 902. Further, yet, it is contemplated that medial sole flap 430*a* and the lateral sole flap 430*b* may be positioned between a bottom surface of a midsole portion and a top surface of an outsole portion of the sole 902. It is further contemplated that alternative and/or additional mechanism for coupling the upper 901 to the sole 902 may be implemented.

Figure 5:
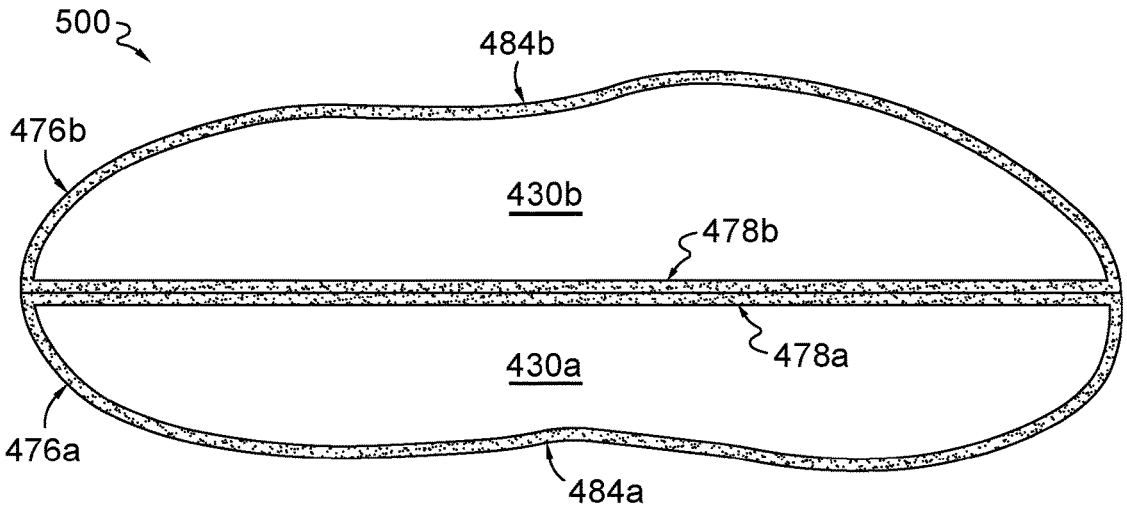
FIG. 5 depicts a bottom-up view of the upper formed in a three-dimensional state from the upper form depicted in FIG. 4, in accordance with aspects herein.

FIG. 5 depicts a bottom perspective 500 of an assembled woven footwear upper form 310 formed in a three-dimensional state from the manufactured substantially planar state, in accordance with aspects herein. The depicted perspective is without a sole attached allowing a view of the various edges mechanically coupled to form the three-dimensional form of an upper. In particular, the lateral sole flap 430*b* and the medial sole flap 430*a* are depicted such that the lateral flap edge 478*b* is coupled with the medial flap edge 478*a* joining the two sole flaps. Similarly, the lateral heel flap edge 476*b* and the medial heel flap edge 476*a* are illustrated and while not explicitly depicted, coupled to the lateral lower heel edge 472*b* and the medial lower heel edge 472*a* respectively. Further, the lateral toe flap edge 480*b* and the medial toe flap edge 480*a* are illustrated and while not explicitly depicted, coupled to the lateral toe edge 482*b* and the medial toe edge 482*a* respectively. The medial sole flap 430*a* may further comprise a medial flap edge 484*a* located on the medial side of the woven footwear upper form 310 at the convergence of the medial sole flap 430*a* and the medial side portion 450*a* approximate an arch location of a foot when received in the interior 903. A corresponding lateral sole flap 430*b* may further comprise a lateral flap edge 484*b* located on the lateral side of the woven footwear upper form 310 at the convergences of the lateral sole flap 430*b* and the lateral side portion 450*b*. It is contemplated that the medial flap edge 484*a* and the lateral flap edge 484*b* are functional to adapt the shape of the woven footwear upper form 310 as it is formed into a three dimensional form having a sole, such as the sole 902. The ability to adapt in the strategic position and geometry provided, in an exemplary aspect, may increase the ease of manufacturing a three dimensional object from the substantially planar woven footwear upper form 310.

In accordance with exemplary aspects, an adhesive or other bonding agent may be applied to a surface portion of the assembled woven footwear upper 310 for securing it to a surface of a bottom unit (such as a sole or midsole). Therefore, it is contemplated that the sewing and or adhering that may be used to form the upper and/or secure the upper to the sole may further aid in reinforcing the coupling of the lateral sole flap 430*b* and the medial sole flap 430*a*, in exemplary aspects.

It is contemplated that any type of lasting construction may be implemented in exemplary aspects. For example it is contemplated that a strobel last (e.g., a material is coupled with the upper along a perimeter portion roughly matching a midsole perimeter) may be utilized in aspects. Further, it is contemplated that a hybrid last may be utilized that incorporates two or more lasting techniques. An example of a hybrid lasting may include utilizing a strobel last in a heel region and a slip last in a metatarsal region of the foot.

The substantially planar woven footwear upper form 310, as described above, may be manufactured from a roll good fabric/textile, or in a sheet-like manner having varied materials (e.g., organic, synthetic), varied manufacturing technique (e.g., differing weaving techniques), varied physical properties (e.g., modulus of elasticity, impact attenuation), and varied geometric properties (e.g., shape, dimension, thickness). It is to be noted that while an exemplary woven upper form 310 is provided, additional configurations may be possible and implemented without departing from the aspects herein. For example, medial and lateral upper components may be cut out in separate pieces, the medial side may comprise more upper portions (i.e., heel quarter, vamp, to box, and the like) than the lateral side of the upper form, or vice versa. Additionally, although aspects herein are described relative to an article of footwear, other type of garments may also benefit from the technology described herein such as, for example, garments, tents, covers, and the like.

The woven footwear upper form 310 is also comprised of functionally-varied regions. Functionally-varied regions are portions of the woven footwear upper form 310 that have varied physical characteristics from other portions of the woven footwear upper form 310. The varied physical characteristics may include a different modulus of elasticity. As used herein, a modulus of elasticity is a measure of ability to stretch in one or more directions. For example, the woven footwear upper form 310 may be comprised of a "non-stretch" portion, a "standard stretch" portion, and a "stretch" portion. The terms are not intended to be literally interpreted, but instead intended to provide a relative measure of elasticity. Therefore, a stretch portion may have a lower modulus of elasticity than a non-stretch portion. This does not imply that a non-stretch portion is without stretch; instead, it means the non-stretch portion is more limited in stretch than a standard or stretch portion of the woven footwear upper form 310.

As described above, the woven fabric/textile in accordance with aspects herein may be woven from a plurality of different types of yarns, each type of yarn comprising physical, chemical, and/or physicochemical properties unique to each type of yarn. For example, the woven textile in accordance with aspects herein may comprise at least three different kinds of weft yarns and at least one type of warp yarns. Specifically, the warp yarns may, for example, be comprised of polyester yarns. More specifically, the warp yarns may, for example, be comprised of polyester yarns weighing between 50 D-600 D. The weft yarns may include, for example polyester yarns, thermoplastic coated polyester yarns, covered elastic core yarns, resilient aramid yarns, and the like. In an exemplary aspect of the woven material in accordance with aspects herein the different weft yarns having different material compositions may be intercalated at the weaving machine (loom) weaves the woven material. For example, the weft yarns may be comprised of 200 D-400 D polyester yarns, 300 D-700 D thermoplastic polyurethane (TPU) coated polyester yarns, 50 D-300 D polyester covered elastic core yarns (e.g. elastane core yarns).

The woven footwear upper form 310 may have strategically placed functional regions, such as stretch regions formed through a plurality of woven cells in the woven footwear upper form 310, as illustrated in FIG. 4. Each woven cell may comprise a particular woven pattern that strategically varies the properties of each woven cell by differentially exposing a particular type of yarn to first and second surfaces of the woven textile. A non-limiting example of a woven material may, for example, comprise 150 D polyester warp yarns, a first 300 D polyester weft yarn, a second 550 D TPU coated polyester weft yarn, a third 140 D elastane core/polyester covered weft yarn. Each of the warp yarns and weft yarns may comprise their respective modulus of elasticity with the third weft yarn having the lowest modulus of elasticity because it is the material having the highest inherent elasticity. Additionally, the third weft yarn may be temperature sensitive, (i.e., dimensionally unstable, in other words, a length of the third weft yarn may be dimensionally reduced) in response to an external stimulus (e.g., temperature). For the purposes herein, the other yarns, i.e., the warp yarn, the first weft yarn, and the second weft yarn, may be at least more dimensionally stable than the third weft yarn when exposed to the external stimulus affecting the third weft yarn.

Figure 6:
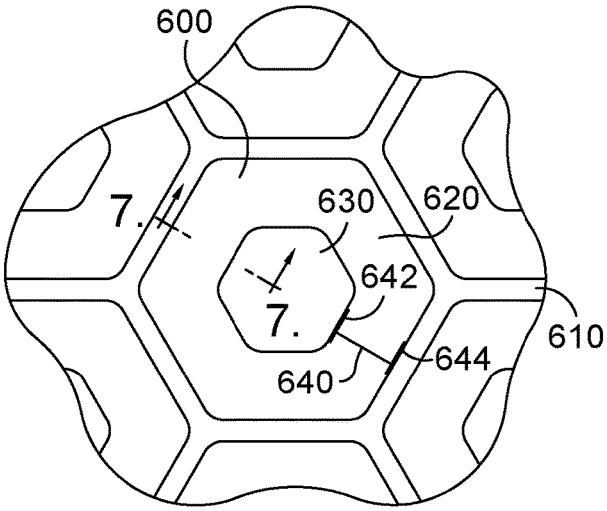
FIG. 6, depicts a close-up view of a woven cell on the fabric/textile piece in accordance with aspects herein.
Figure 7:
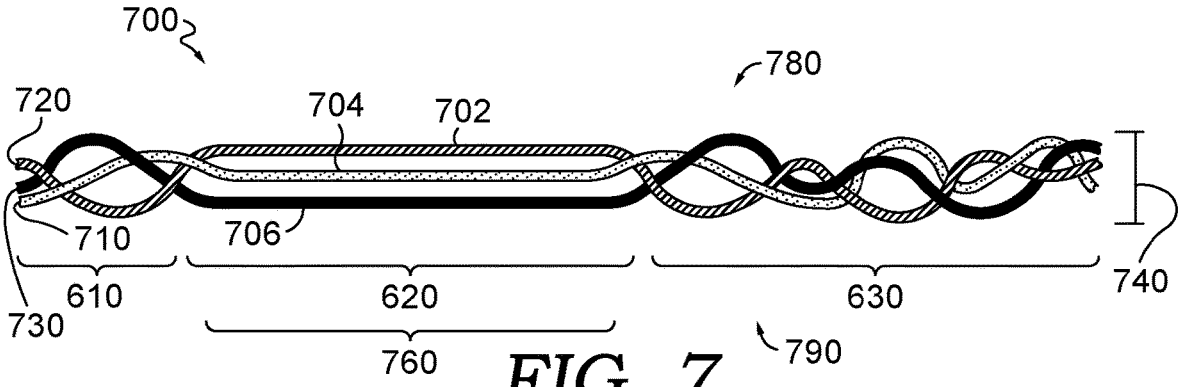
FIG. 7 depicts a close-up cross-sectional representative view of the fabric/textile in a first physical state in accordance with aspects herein, along the line 7-7 depicted in FIG. 6.
Figure 16:
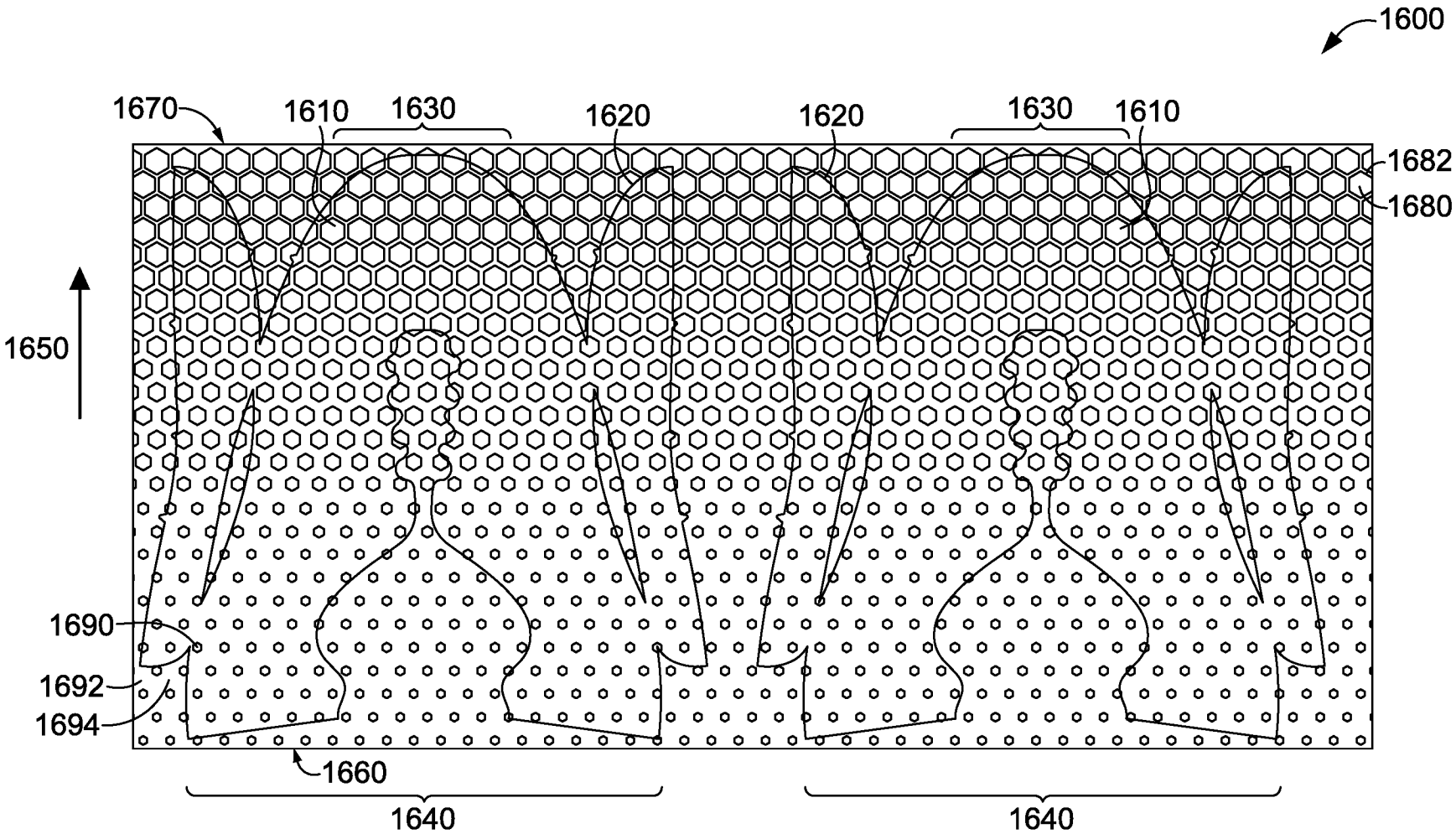
FIG. 16 depicts an exemplary fabric/textile section in accordance with aspects herein, with one or more upper form outlines indicated on the fabric/textile section.
Figure 17:
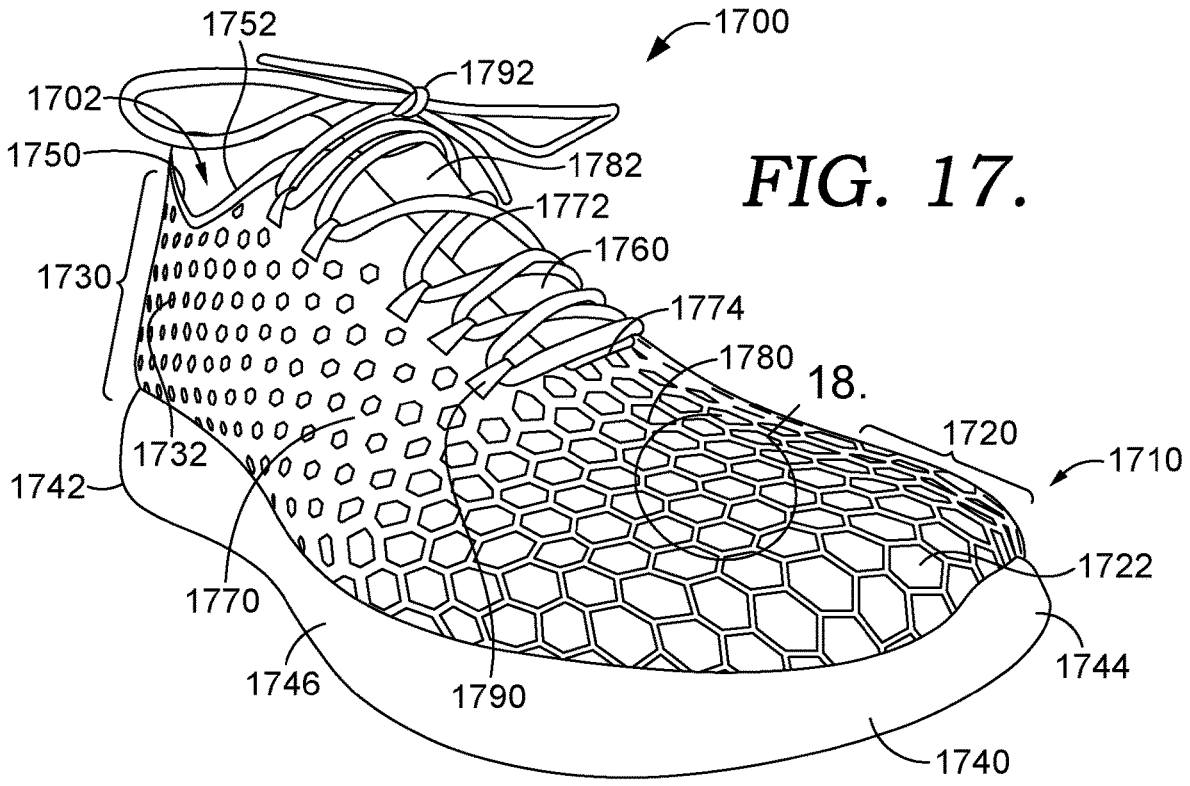
FIG. 17 depicts a perspective view of an article of footwear comprised of a zonal stretch upper in an as-worn configuration, in accordance with aspects herein.
Figure 18:
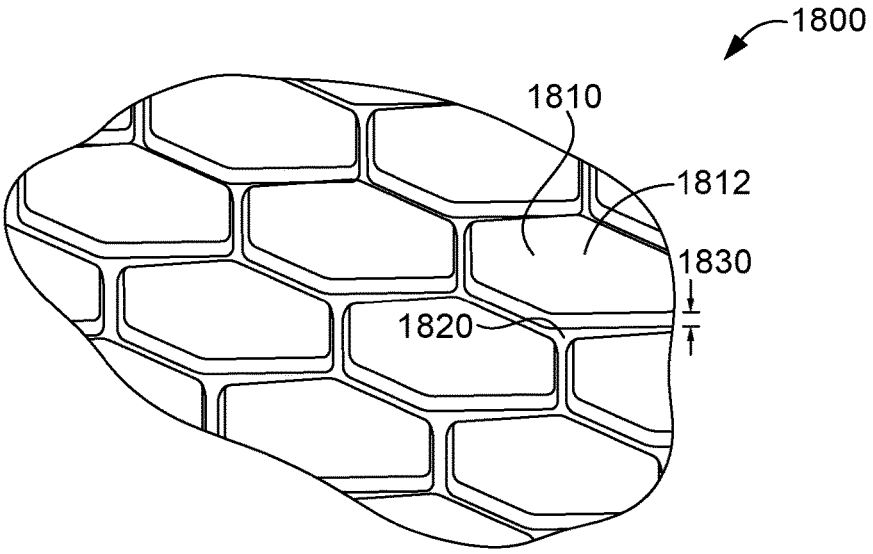
FIG. 18 depicts a close-up view of a portion of the article of footwear enclosed by area 18 in FIG. 17, in accordance with aspects herein.

As depicted in FIG. 6, each woven cell 600 may be enclosed within a perimeter 610. Although aspects herein contemplate a substantial enclosure within the perimeter 610, it is envisioned that each woven cell 600 may be between 5% and 100% enclosed, 10% enclosed, 15% enclosed, 20% enclosed, 25% enclosed, 30% enclosed, 35% enclosed, 40% enclosed, 50% enclosed, 55% enclosed, 60% enclosed, 65% enclosed, 70% enclosed, 75% enclosed, 80% enclosed, 85% enclosed, 90% enclosed, 95% enclosed, and the like, and still have identifiably discrete cells. Further, each woven cell 600 may include one or more distinct regions, for example, each woven cell 600 may enclose a reactive region 620 and a non-reactive region 630, the non-reactive region being enclosed within each reactive region 620 (as shown.) As depicted in FIG. 7, which is a close up view of the cross-section of the woven cell 600 along the line 7-7, at the perimeter 610 and at the non-reactive region 630, the warp yarns (not shown), the first weft yarn 710, the second weft yarn 720, and the third weft yarn 730 may be interwoven with each other while in the reactive region 620, a portion of the warp yarns may be interwoven with the second weft yarn 720 to form a first outer layer 702, the first weft yarn 710 may be allowed to "float" to form a second middle layer 704 (i.e. middle layer), alternatively, a portion of the warp yarns (one or more warp yarns in each reactive region 620) may be allowed to interact (i.e., be interwoven) with the first weft yarn to form the second middle layer 704, and a portion of the warp yarns may be interwoven with the third weft yarn 730 to form a third outer layer 706. It is contemplated that a cross-sectional view of a woven cell comprising only a reactive region would be substantially the same as that shown in FIG. 7 except that the line 7-7 in FIG. 6 would be extended to cut through the whole woven cell 600 as opposed to the portion shown. In other words, in the example where only a reactive region is enclosed within each woven cell, such as shown in FIGS. 16-18, the cross-sectional view would be comprised of a perimeter portion equivalent to perimeter 610 where the first, second, and third yarns are interwoven with each other and a reactive region equivalent to the reaction region 620 where a portion of the warp yarns may be interwoven with the second weft yarn (e.g., weft yarn 720) to form a first layer (e.g., first outer layer 702.) The first weft yarn (e.g., the first weft yarn 710) may be allowed to "float" to form a second layer (e.g., second middle layer 704.) Alternatively, a portion of the warp yarns (e.g., one or more warp yarns in each reactive region 620) may be allowed to interact (i.e., the interwoven) with the first weft yarn to form the second layer (e.g., second middle layer 704,) and a portion of the warp yarns may be interwoven with the third weft yarn (e.g., weft yarn 730) to form a third layer (e.g., third outer layer 706.) Then, in a second perimeter portion, all the first, second, and third yarns may be shown as being interwoven with each other equivalent to what is shown in FIG. 7 as the non-reactive region 630, for example.

Figure 8:
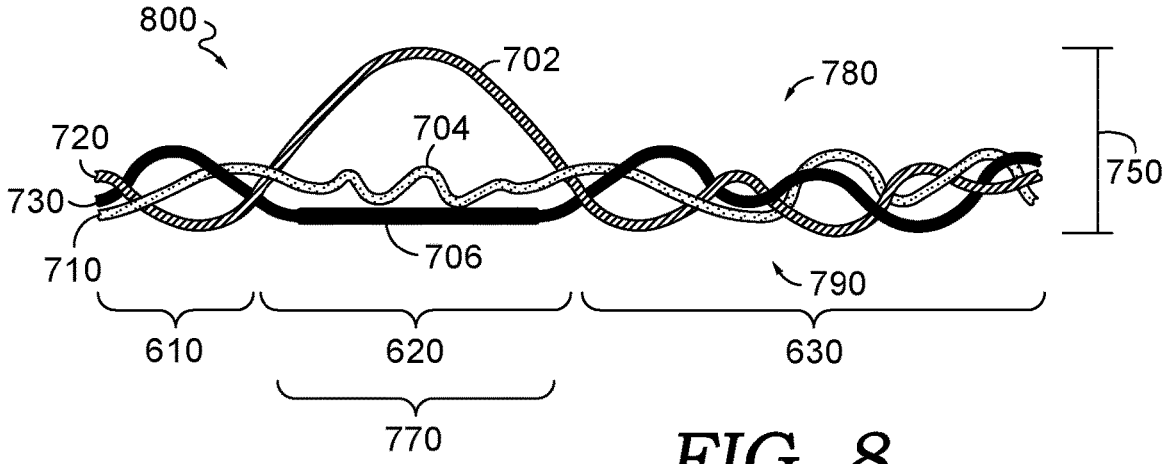
FIG. 8 depicts a close-up cross-sectional representative view of the fabric/textile in FIG. 8, in a second physical state in accordance with aspects herein.

Prior to exposing the woven material to an external stimulus in accordance with aspects herein, such as the fabric/textile piece 300 depicted in FIG. 3, the woven material may comprise as described above, a substantially planar configuration having a thickness 740, as shown in FIG. 7. The fabric/textile piece 300 and more specifically, the third weft yarn 730 in this first physical state (i.e. prior to exposing it to the external stimulus) may comprise, for example, a first length 760 in the reactive region. However, once exposed to the external stimulus (e.g., moisture (i.e., steam) at a temperature that is at or above 100° C. but below 150° C.), the third weft yarn 730 may shrink to a second length 770 in the reactive region, as shown in FIG. 8. Since the first weft yarn 710 and the second weft yarn 720 are substantially more dimensionally stable relative to the third weft yarn 730 and may comprise some stiffness due to an optional TPU coating, in response to the external stimulus, the first outer layer 702 may be caused to rise above the substantially planar surface, thereby increasing the thickness of the fabric/textile piece 300 to a second thickness 750 at least in the reactive region(s) 620. Further, since the first weft yarn 710 forming the second middle layer 704 is also dimensionally more stable relative to the third weft yarn 730 in response to the external stimulus, the first weft yarn 710 in the second middle layer 704 may be caused to bend or fold, as shown. As observed from FIGS. 7 and 8, the woven material comprises a first surface 780 and a second surface 790. The first surface 780 exposes the first outer layer 702 woven from the second weft yarn 720 that may be coated with a thermoplastic material (e.g., TPU) in each reactive region 620 of each woven cell 600 and, the second surface 790 exposes the third outer layer 706 woven from the third weft yarn 730 that may comprise an elastic core (e.g., elastane) in each reactive region 620 of each woven cell 600. Thus, the dimensional change of the third outer layer 706 induced by the exposure to the external stimulus, further induces a transformation in at least the first surface 780 from substantially planar to texturized with grooves and ridges, as will later be discussed with reference to FIG. 10. Because of this texturization after, for example, steaming, the woven material may gain a dimensional visual appeal as a result of the thermoplastic coated material being exposed in the first outer layer 702 of the reactive region 620, the first surface 780 may be used as an outer surface (exposed to an outer environment outside of the article of footwear) and the second surface 790 may be used as an inner surface (facing a foot of a wearer when the article of footwear is worn). Furthermore, although particular materials are described above in reference to the first weft yarn 710, the second weft yarn 720, and the third weft yarn 730, it is contemplated that other different materials having other or similar properties may also be employed without departing from aspects herein. For example, aramid, polyester, cotton, silk yarns, and the like may be used in place of the first weft yarn 710 or the second weft yarn 720, without departing from aspects herein.

The stretch properties of the woven material in accordance with aspects herein, may therefore be controlled according to the types of yarns and the amount of reactive region present in each individual woven cell. In other words, the larger an area occupied by the reactive region in a single woven cell, the more elastic the woven cell becomes. However, because of the higher modulus of elasticity (compared to the third weft yarn 730) of the first weft yarn 710 and the second weft yarn 720 present in the first outer layer 702 and the second middle layer 704, respectively, the amount of stretch of a particular woven cell may be "locked down" or, in other words, limited to the stretched length of the first weft yarn 710 that is floating in the second middle layer 704 and/or the distance 640 in FIG. 6 (or the first length 760 shown in FIG. 7) that may be defined as being between edge 642 of the non-reactive region 630 and edge 644 of the perimeter 610 that abut the reactive region 620 in each cell (as shown), or in the case where the non-reactive region is absent, from a first perimeter edge to a second perimeter edge located across from the first perimeter edge (not shown).

Prior to exposing the woven material to an external stimulus in accordance with aspects herein, such as the fabric/textile piece 300 depicted in FIG. 3, the woven material may comprise as described above, a substantially planar configuration having a thickness 740, as shown in FIG. 7. The fabric/textile piece 300 and more specifically, the third weft yarn 730 in this first physical state (i.e. prior to exposing it to the external stimulus) may comprise, for example, a first length 760 in the reactive region. However, once exposed to the external stimulus (e.g., moisture (i.e., steam) at a temperature that is at or above 100° C. but below 150° C.), the third weft yarn 730 may shrink to a second length 770 in the reactive region, as shown in FIG. 8. Since the first weft yarn 710 and the second weft yarn 720 are substantially more dimensionally stable relative to the third weft yarn 730 and may comprise some stiffness due to an optional TPU coating, in response to the external stimulus, the first layer 702 may be caused to rise above the substantially planar surface, thereby increasing the thickness of the fabric/textile piece 300 to a second thickness 750 at least in the reactive region(s) 620. Further, since the first weft yarn 710 forming the second (middle) layer 704 is also dimensionally more stable relative to the third weft yarn 730 in response to the external stimulus, the first weft yarn 710 in the second In accordance with aspects herein, when for example, the woven footwear upper form 310 in FIG. 4 is formed into a footwear upper 910 for an article of footwear 900, such as the one shown in FIG. 9, the woven cells 920 comprising the larger reactive regions 620 may be located near the toe box area 940 and the woven cells 930 comprising the larger non-reactive regions 630 and/or thicker perimeters, may be located near the heel or quarter area 950 of the article of footwear. This particular orientation may be strategic because the higher levels of stretch may be provided where needed most, to provide an article of footwear, such as article of footwear 900, that is comfortably able to adapt to a wearer's foot and at the same time, provide support to the foot via the built in "lock down" mechanism of each woven cell.

The articles of footwear depicted in FIG. 9 is thus, comprised of a footwear upper 910 that is multi-zonal in an as-worn position. The construction of the articles of footwear 900 in accordance herein, may have the basic construction of an athletic-type shoe. However, it should be understood that the novel concepts described herein could be employed on other types of footwear, garments, or any other type of article of manufacture that comprises a fabric/textile that is not necessarily a garment type article (e.g. curtains, rugs, upholstery, and the like). Because much of the construction of the article of footwear 900 is the same as that of a conventional athletic shoe, the conventional features of the constructions will be described only generally herein. Additionally, relative location terminology will be utilized herein. For example, the term "proximate" is intended to mean on, about, near, by, next to, at, and the like. Therefore, when a feature is proximate another feature, it is close in proximity but not necessarily exactly at the describe location, in some aspects.

The article of footwear 900 comprises a sole 902 that may be constructed from resilient materials that are typically employed in the construction of soles of athletic shoes. The sole 902 can be constructed with an outsole, a midsole, and an insert, as is conventional. The sole 902 comprises a bottom surface that functions as the traction surface of the shoe, and an opposite top surface (not shown.) The size of the article of footwear 900 comprises a length that extends from a rear sole heel end 906 to a front toe end 904 of the sole 902. The sole 902 comprises a width that extends between a medial side (not shown) and a lateral side 908 of the sole 902.

The footwear upper 910 may be secured to the sole 902 and extend upwardly from the sole 902, such as from the sole top surface. The footwear upper 910 may be constructed of a flexible material, such as the woven material described above. The footwear upper 910 may be constructed with a heel or quarter area 950 that extends around the sole 902 at the rear sole heel end 906. The heel or quarter area 950 extends upwardly from the sole 902 to an ankle edge 960 defining, in part, an ankle opening 962. The ankle opening 962 provides access to the shoe interior.

From the heel or quarter area 950, the footwear upper 910 has a medial side portion (not shown) and an upper lateral side portion 970 that extend along the respective sole medial side and the sole lateral side 908. The upper medial side portion extends upwardly from the sole medial side to an upper medial side edge (not shown). The upper lateral side portion 970 extends upwardly from the sole lateral side 908 to an upper lateral side edge 972. As illustrated in the figures, the upper medial side edge and the upper lateral side edge 972 extend rearwardly from opposite sides of a toe box area 940 forming, in combination, an upper edge 942. The length of the upper medial side edge and the upper lateral side edge 972 define a forefoot opening 974 in the footwear upper 910 that opens to the shoe interior 903.

The footwear upper 910 is also constructed with the toe box area 940 that extends around and across the sole top surface at the front toe end 904. The toe box area 940 is connected between the upper medial side portion and the upper lateral side portion 970 and encloses a portion of the shoe interior 903 adjacent the front toe end 904. The upper medial side edge and the upper lateral side edge 972 extend rearwardly from the toe box area 940.

A plurality of lacing mechanisms 990 are provided on the upper medial side portion and on the upper lateral side portion 970. The lacing mechanisms may be an aperture through which a string or lace is intended to pass. Additional lacing mechanisms are also contemplated such as hooks, loops, integrated fibers/strings, and the like. For example, the lacing mechanisms 990 may be lacing openings that are typically occupied by a portion of a fastener, such as lacing that close the footwear upper 910 over the forefoot opening 974 of the article of footwear 900. The lacing mechanisms 990 may be eyelet or grommet style aperture, string or ribbon loops, and the like. The lacing mechanisms 990 are arranged in lines along the upper medial side portion and the upper lateral side portion 970, as is conventional. As illustrated in the figures, the lacing mechanisms 990, may extend substantially the entire length of the upper medial side edge and the upper lateral side edge 972. However, it is also contemplated that the footwear upper may not comprise forefoot opening 974, but rather, be enclosed such as in an article of footwear resembling a loafer type construction.

The footwear upper 910 includes a vamp 944 or a throat positioned rearwardly of the toe box area 940, and an optional tongue 946 may extend rearwardly from the vamp 944 through the forefoot opening 974. The optional tongue 946 may extend along the lengths of the upper medial side portion and the upper lateral side portion 970 to a distal end of the tongue near an ankle opening 962. The length and \width of the tongue may position the tongue side edges beneath the upper medial side portion and the upper lateral side portion 970, and may optionally extend the tongue over the forefoot opening 974 of the article of footwear 900.

Figure 10:
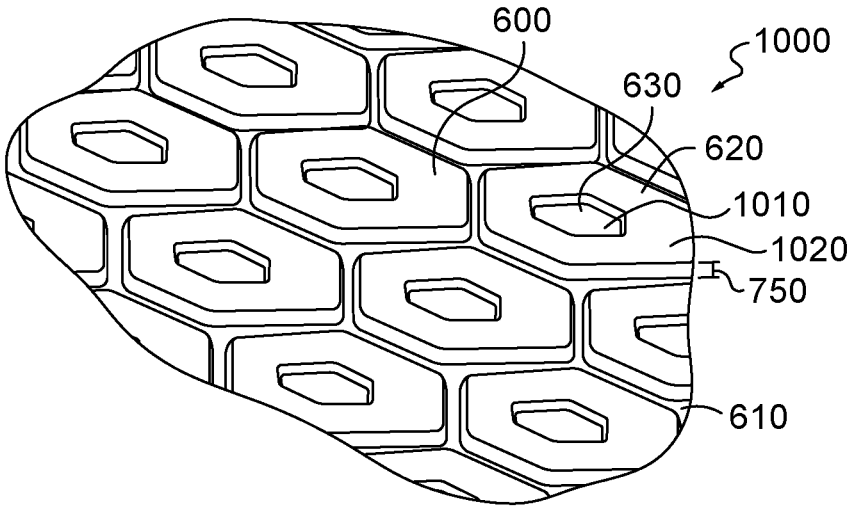
FIG. 10 depicts a close-up view of a portion of the article of footwear enclosed by area 10 in FIG. 9, in accordance with aspects herein.

FIG. 10 displays a close up view 1000 of the region within the circle 10 shown in FIG. 9. As seen, the article of footwear 900 is manufactured from a woven material or woven footwear upper form 310, for example, post treatment with an external stimulus (e.g. steam at a temperature between 100° C. and 150° C.) to induce a dimensional change in the third weft yarn in the reactive region 620. As shown in FIG. 10, each woven cell 600 may be separated from adjacent woven cells by perimeter 610, and comprises a reactive region 620 and a non-reactive region 630. As seen in FIG. 10, the reactive regions 620 of each woven cell 600 form "ridges" 1020 and the non-reactive regions 630 including the perimeter 610, form "grooves" 1010, giving the footwear upper 910 a texturized outer surface.

Figure 11:
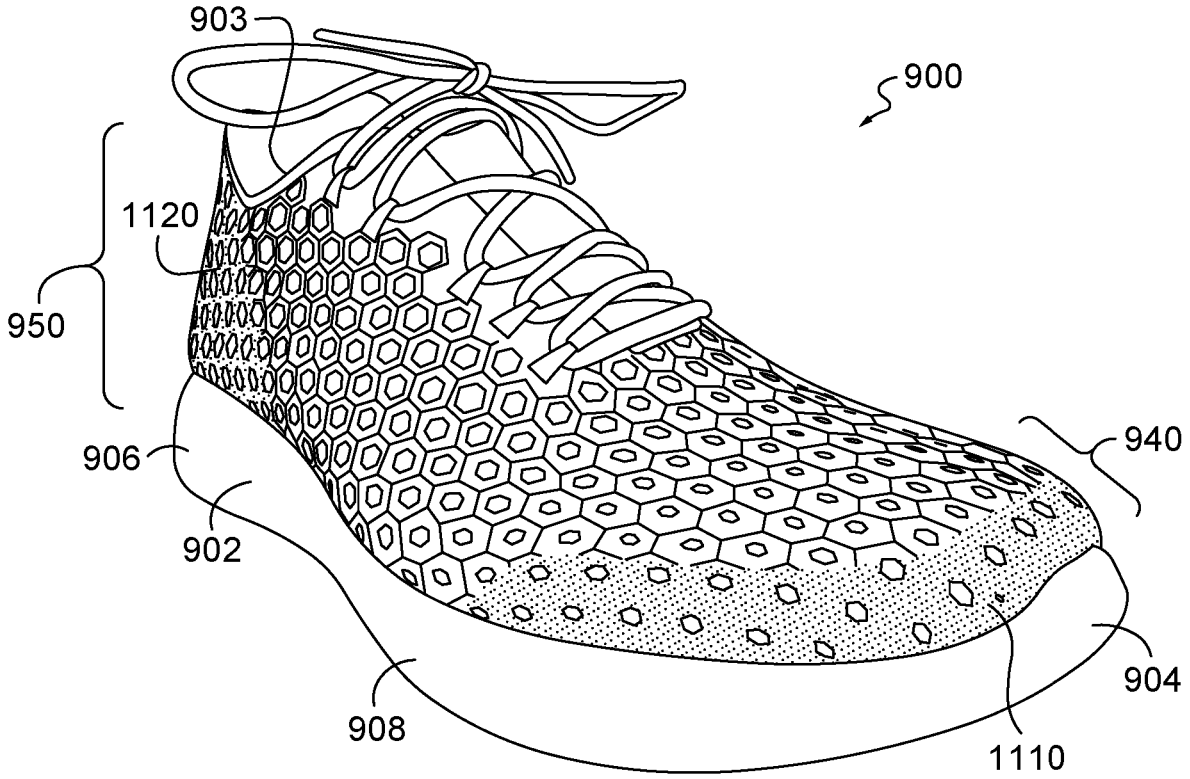
FIG. 11 depicts a perspective view of an article of footwear comprised of a zonal stretch upper in an as-worn configuration, further comprising reinforced portions, in accordance with aspects herein.

As described above in reference to FIG. 7, the first surface 780 in the reactive region 620 comprises the second weft yarn in the first outer layer 702 and the second surface 790 comprises the third weft yarn in the third outer layer 706 with the second middle layer 704 comprising the first weft yarn. As such, another advantage of the footwear upper 910 constructed in accordance with aspects herein is that the footwear upper may be further treated with, for example, heat and pressure, to form a reinforcement layer on particular locations of the footwear upper 910 for added durability. For example, as shown in FIG. 11, the toe box area 940 of the article of footwear 900 may further comprise a reinforcement 1110 extending around the toe box area 940 proximal to the front toe end 904 of the sole 902. Another area in which a reinforcement layer may be provided is in the quarter area 950 of the article of footwear 900, as reinforcement 1120. The reinforcements 1110 and 1120 may extend as far as to cover, the whole footwear upper 910, a lower portion of the footwear upper 910, abutting the sole 902, or as shown, may wrap the regions of the lateral, center, and toe box area 940. The reinforcement layer(s) (i.e., 1110 and 1120 in the present example) may be formed by applying heat and pressure to the article of footwear 900 only onto the areas where the reinforcement layer is desired. When the heat and pressure are applied, the thermoplastic material present at least in the first outer layer 702 of the reactive region 620 of each woven cell 600, may be melted or thermally formed and allowed to set by cooling in the reinforced areas. Thus, the thermoplastic material will form a film like reinforcement layer that is hardened to resist abrasion, and the like. Further, because of the woven cells in the reinforcements 1110 and 1120 will be further "locked" into position by the film like reinforcement layer.

Figure 12:
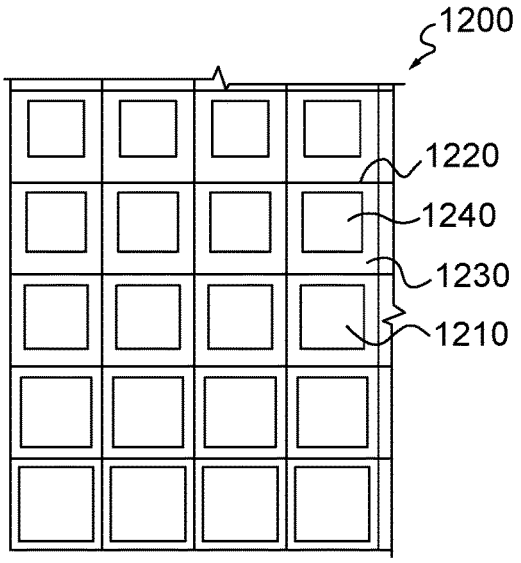
FIG. 12 depicts an exemplary configuration for the fabric/textile in accordance with aspects herein.

The woven cells such as woven cell 600 depicted in the exemplary woven materials and footwear constructions in FIGS. 1-11 have been shown as comprising a hexagonal shape. However, it is to be noted that many other stackable shapes may be used, depending on the aesthetics and functionality desired in the final woven product. For example, FIG. 12 shows a woven material 1200 comprising a plurality of square woven cells 1210, each woven cell in the plurality of woven cells 1210 being defined by a perimeter 1220. Further, each woven cell in the plurality of woven cells 1210 may comprise one or more distinct regions. For example, each woven cell in the plurality of square woven cells 1210 comprises a reactive region 1230 and a non-reactive region 1240 enclosed within the reactive region 1230. Also, as shown, the area occupied by the respective reactive region(s) 1230 and non-reactive region(s) 1240 within the woven cell(s) 1210 may be increased or decreased as desired, thus, giving zonal stretchability to the woven material 1200, where the woven cells 1210 having a greater area ratio of reactive region 1230 to non-reactive region 1240 have a greater stretchability than the cells having a greater area ration of non-reactive region 1240 to reactive region 1230.

Figure 13:
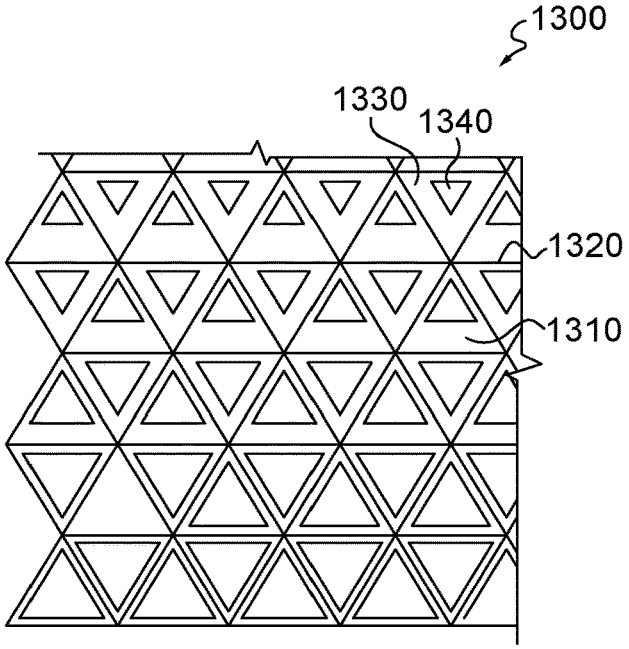
FIG. 13 depicts another exemplary configuration for the fabric/textile in accordance with aspects herein.

Similarly, FIG. 13 shows a woven material 1300 comprising a plurality of triangular woven cells 1310, each woven cell in the plurality of triangular woven cells 1310 being defined by a perimeter 1320. Further, each woven cell in the plurality of triangular woven cells 1310 may comprise one or more distinct regions. For example, each woven cell in the plurality of triangular woven cells 1310 comprises a reactive region 1330 and a non-reactive region 1340 enclosed within the reactive region 1330. Also, as shown, the area occupied by the respective reactive region(s) 1330 and non-reactive region(s) 1340 within the woven cell(s) 1310 may be increased or decreased as desired, thus, giving zonal stretchability to the woven material 1300, where the plurality of triangular woven cells 1310 having a greater area ratio of reactive region 1330 to non-reactive region 1340 have a greater stretchability than the cells having a greater area ration of non-reactive region 1340 to reactive region 1330.

Figure 14:
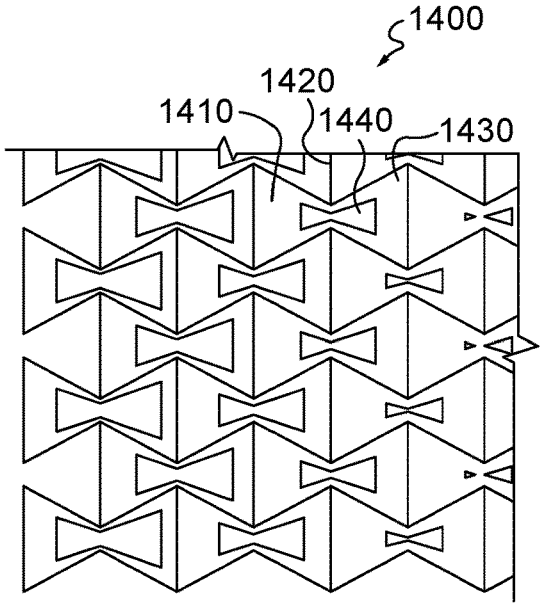
FIG. 14 depicts an additional exemplary configuration for the fabric/textile in accordance with aspects herein.

Further, FIG. 14 shows a woven material 1400 comprising a plurality of auxetic hexagonal woven cells 1410, each woven cell in the plurality of auxetic hexagonal woven cells 1410 being defined by a perimeter 1420. Further, each woven cell in the plurality of auxetic hexagonal woven cells 1410 may comprise one or more distinct regions. For example, each woven cell in the plurality of auxetic hexagonal woven cells 1410 comprises a reactive region 1430 and a non-reactive region 1440 enclosed within the reactive region 1430. Also, as shown, the area occupied by the respective reactive region(s) 1430 and non-reactive region(s) 1440 within the woven cell(s) 1410 may be increased or decreased as desired, thus, giving zonal stretchability to the woven material 1400, where the plurality of auxetic hexagonal woven cells 1410 having a greater area ratio of reactive region 1430 to non-reactive region 1440 have a greater stretchability than the cells having a greater area ration of non-reactive region 1440 to reactive region 1430. The auxetic shape of the auxetic hexagonal woven cells 1410, may further provide another dimension of stretch to the woven material 1400, that is inherent to auxetic materials, where an auxetic material comprises a negative Poisson's ratio meaning that when stretched, the auxetic material becomes thicker or wider in a direction that is perpendicular to the applied force.

Figure 15:
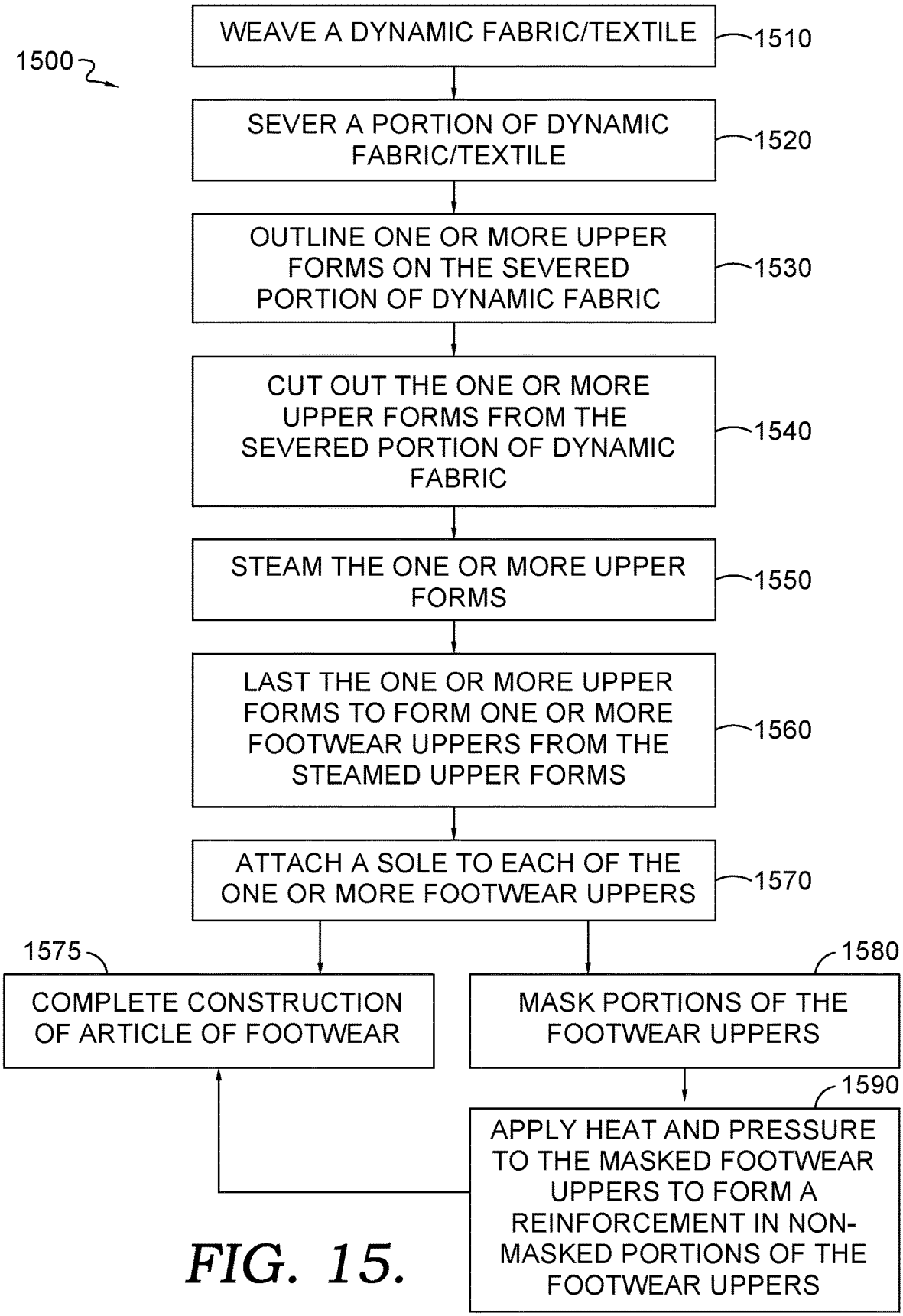
FIG. 15 depicts a schematic view of an exemplary method of construction of an article of footwear from the fabric/textile in accordance with aspects herein.

Moving on to FIG. 15, a schematic view of an exemplary method of construction of an article of footwear from the dynamic fabric/textile in accordance with aspects herein, is provided. The fabric/textile is dynamic because it is capable of undergoing a physical change from a first physical state (substantially planar) to a second physical state (three dimensional, i.e. texturized). At step 1510, the fabric/textile may be woven, the fabric/textile comprising a plurality of discrete woven cells, each woven cell in the plurality of woven cells being separated from a neighboring cell by a perimeter, the perimeter may comprise a single layer construction being formed by interweaving at least a first weft yarn with a warp yarn. Further, each woven cell may be woven to comprise a reactive region enclosed substantially within the perimeter (between 5% and 100% enclosed, 10% enclosed, 15% enclosed, 20% enclosed, 25% enclosed, 30% enclosed, 35% enclosed, 40% enclosed, 50% enclosed, 55% enclosed, 60% enclosed, 65% enclosed, 70% enclosed, 75% enclosed, 80% enclosed, 85% enclosed, 90% enclosed, 95% enclosed, and the like), and optionally, each woven cell may further comprise a non-reactive region enclosed substantially within the reactive region (between 5% and 100% enclosed, 10% enclosed, 15% enclosed, 20% enclosed, 25% enclosed, 30% enclosed, 35% enclosed, 40% enclosed, 50% enclosed, 55% enclosed, 60% enclosed, 65% enclosed, 70% enclosed, 75% enclosed, 80% enclosed, 85% enclosed, 90% enclosed, 95% enclosed, and the like). The reactive region may comprise a three layer construction with each layer comprising at least one of the first weft yarn, a second weft yarn, or a third weft yarn. The first weft yarn may be comprised of, for example, a polyester yarn, the second weft yarn may be comprised of a thermoplastic coated yarn, and the third weft yarn may be comprised of an elastic yarn, the third yarn being dimensionally unstable when exposed to an external stimulus (e.g. steam). In accordance with aspects herein, the first layer of the reactive region may be formed by interweaving the second weft yarn with the warp yarn, the second layer of the reactive region may comprise mainly the first yarn and be formed by floating the first yarn, and the third layer may be formed by interweaving the third weft yarn with the warp yarn. The non-reactive region, when present, may comprise a single layer construction being formed by interweaving at least the first weft yarn with the warp yarn similar to or in the same manner as the construction of the perimeter. Preferably, the perimeter (and the non-reactive region) may be formed by interweaving all yarns including the first weft yarn, the second weft yarn, the third weft yarn, and the warp yarn.

At step 1520, a portion of the fabric/textile woven at step 1510 may be severed from the rolled good. At step 1530, one or more outlines of one or more upper forms may be optionally provided on the portion of fabric/textile by for example, drawing, stenciling, and the like. At step 1540, the one or more upper forms may be cut out from the fabric/textile portion along the outlines, or alternatively, the one or more upper forms may be die cut or laser cut without having to perform step 1530. An advantage of high energy cutting methods such as laser cutting, is that a seal around the cut edges may be formed simultaneously when cutting, thereby preventing the upper form from, for example, unraveling. This is particularly useful when using synthetic yarns, or a combination of synthetic yarns with natural yarns.

At step 1550, the one or more upper forms cut out from the fabric/textile portion may be steamed or otherwise exposed to an external stimulus to cause the dimensionally unstable third weft yarn in the reactive region of each woven cell to shrink (reduction in length), thereby changing the texture of the fabric. In other words, as the third yarn changes from a first physical state (normal state) to a second physical state (shrunken state: e.g. a reduction in longitudinal length), the first and second layers in the reactive regions may change from a substantially planar state to a bent state Although the steaming step is described here as happening after the one or more upper forms are cut out from the fabric/textile piece. It is contemplated that the steaming step may happen prior to the cutting step, for example, after the fabric/textile portion is severed from the roll good but prior to the upper forms being cut out from the fabric/textile portion.

At step 1560, the one or more steamed footwear upper forms may be lasted to form one or more footwear uppers.

At step 1570, a sole may be attached to the one or more lasted footwear uppers to form one or more articles of footwear. At step 1575, the construction of the one or more articles of footwear may be completed by putting finishing touches such as lacing, and the like. Optionally, if reinforcement is desired in certain areas of the one or more articles of footwear that are prone to abrasion (e.g., toe box area, quarter area), a mask may be applied to areas where the reinforcement is not desired at step 1580, leaving only the areas where reinforcement is desired exposed. At step 1590, heat and pressure may be applied to the article of footwear to melt the thermoplastic material in the first layer of the reactive region of each woven cell, thereby forming a hardened film-like covering in the exposed areas. An additional advantage of the reinforcement is the "locking down" of the woven cells in the reinforced areas (no stretch in the reinforced areas). Although this reinforcing step is discussed as happening after the one or more articles of footwear are constructed, it is contemplated that this reinforcement step may be performed prior to lasting the one or more upper forms when they are still in their "flat" configuration (e.g., substantially planar). Then the construction of the one or more articles of footwear may be completed by putting finishing touches as indicated at step 1575.

It is to be noted that prior to treating the fabric/textile with steam to induce the dimensional change in the third weft yarn, the fabric/textile in accordance with aspects herein may be limited in stretch (relative to post steaming) and its modulus of elasticity may be determined by the first and second weft yarns. However, after inducing the dimensional change in the third weft yarn, it can be deduced that the overall size of the fabric portion and in particular the size of the fabric portion in the weft direction may be diminished. As described above, because of the dimensional change in the third weft yarn in the third layer of the reactive region, the stable second layer and first layer of the reactive region may become bent or raised (e.g., forming a dimensionally textured surface on the textile) because these layers do not undergo a dimensional change (shrinkage) at least to the same extent/degree as the third weft yarn, thereby creating a textured surface with grooves (non-reactive regions and perimeters) and ridges (reactive regions). Further, because the first, second, and third weft yarns are separated into their own layers in the reactive regions, the fabric/textile may become stretchable and its modulus of elasticity may be defined, in part, by the modulus of elasticity of the third yarn. As such, the modulus of elasticity of the overall woven fabric/textile may be reduced or in other words, the modulus of elasticity of the woven fabric/textile prior to inducing the dimensional change in the third layer may be greater than the modulus of elasticity of the overall woven fabric/textile after the dimensional change is induced in the third layer and more specifically in the third yarn. Furthermore, because the first and second layers of the reactive region of each woven cell are inherently not as stretchy (i.e., have a higher modulus of elasticity than the third layer) as the third layer, the amount of stretch in the weft direction of the woven fabric/textile may be limited by the stretchiness of the first and second layers of the reactive region in each of the woven cells. In other words, the amount of stretch of the fabric/textile in the weft direction (i.e., the extent to which the fabric/textile can stretch) may be limited or "locked" by the first layer and/or the second layer because once the first layer and/or the second layer of the dynamic region are returned to their original state (are straightened), the overall fabric/textile will not stretch anymore.

FIG. 16 depicts a fabric/textile piece 1600 that may be cut from, for example a roll good fabric/textile 100 (e.g., as shown in FIG. 1). As shown, multiple woven footwear upper forms 1610 may be formed from the fabric/textile piece 1600. In the non-limiting particular example shown in FIG. 16, the fabric/textile piece 1600 comprises two exemplary outlines 1620 of two woven footwear upper forms 1610. Further, the outlines 1620 for the woven footwear upper forms 1610 are provided in such a way that the heel ends 1640 of the woven footwear upper forms 1610 are located near the first end 1660 of the fabric/textile piece 1600 and the toe ends 1630 of the woven footwear upper forms 1610 are located near the second end 1670 of the fabric/textile piece 1600. The gradient 1650 formed by the reactive regions in each woven cell runs from smallest near the heel ends 1640 to largest at the toe ends 1630. This configuration allows for greater stretchability near the toe ends 1630. In other words, the proper orientation of the gradient 1650 allows for the formation of a functionally appropriate footwear upper having varied characteristics in the footwear upper that are introduced by the gradient configuration of the gradient 1650 described herein. In other words, the stretch properties of the woven material may be influenced by the amount of reactive region present in each woven cell due to the specific configuration of yarns in the reactive regions versus the non-reactive regions, as described above with respect to FIGS. 6, 7, and 8 prior to and after treatment (for causing the woven fabric/textile to become texturized.) Once the upper forms 1610 are cut out of the fabric/textile piece 1600 (by, for example, die cutting, manual cutting, laser cutting, trimming, sheering, etching, burning, melting or any other known technique,) each upper form 1610 will yield a substantially planar upper form 1610 having the same characteristics of the upper form 310 described with respect to FIGS. 4 and 5, above.

Specifically, as it can be seen in the fabric/textile piece 1600, the zonal characteristics of the fabric are provided by having woven cells 1680 with the larger reactive regions being enclosed by a perimeter 1682 that is configured as a non-reactive region, near the toe ends 1630; and the woven cells 1690 with the smaller reactive regions being enclosed by a perimeter portion 1692 that is continuous with or "blended in" with a non-reactive region 1694, near the heel ends 1640. In other words, instead of the reactive region enclosing a non-reactive region within each cell, as shown above with respect to the fabric/textile piece 300 in FIG. 3, for example, in the fabric/textile piece 1600, a non-reactive region encloses a reactive region within each woven cell, where each woven cell is defined by a perimeter, and where the perimeters of the plurality of woven cells, forming the fabric/textile, are interconnected. Since the perimeters are non-reactive and are constructed similarly to the non-reactive regions, in the exemplary fabric/textile 1600, the perimeters defining each woven cell may appear to gradually become thinner in the direction of the gradient 1650, as a size of the reactive region in each cell is gradually increased.

FIG. 17 depicts an exemplary article of footwear 1700 similar to the one depicted in FIG. 9, but constructed from, for example, an upper form 1610, in accordance with aspects herein, where no non-reactive region is provided within the reactive region of each woven cell. The article of footwear 1700 is thus comprised of at least an upper 1710 that is multi-zonal in an as-worn configuration. As shown, the woven cells comprising the largest reactive regions 1722 are located near the toe box area 1720 and the woven cells comprising the smallest reactive regions 1732 are located near the heel or quarter area 1730. As described with respect to article of footwear 900 in FIG. 9, this orientation is strategic because it provides higher levels of stretch where needed most for a comfortable feel while at the same time, providing adequate support via the built in "lock down" mechanism of each woven cell.

The article of footwear 1700 comprises a sole 1740 that may be constructed from resilient materials that are typically employed in the construction of soles of athletic shoes. The sole 1740 can be constructed with an outsole, a midsole, and an insert, as is conventional. The sole 1740 comprises a bottom surface that functions as the traction surface of the shoe, and an opposite top surface (not shown.) The size of the article of footwear 1700 comprises a length that extends from a rear sole heel end 1742 to a front toe end 1744 of the sole 1740. The sole 1740 comprises a width that extends between a medial side (not shown) and a lateral side 1746.

The footwear upper 1710 may be secured to the sole 1740 and extend upwardly from the sole 1740, such as from the sole top surface (not shown.) The footwear upper 1710 may be constructed of a flexible material, such as the woven materials described above. The heel or quarter area 1730 extends upwardly from the sole 1740 to an ankle edge 1750 defining, in part, an ankle opening 1752. The ankle opening 1752 provides access to the shoe interior.

From the heel or quarter area 1730, the footwear upper 1710 has a medial side portion (not shown) and an upper lateral side portion 1770 that extend along the respective sole medial side and the sole lateral side 1746. The upper medial side portion extends upwardly from the sole medial side to an upper medial side edge (not shown). The upper lateral side portion 1770 extends upwardly from the sole lateral side 1746 to an upper lateral side edge 1772. As illustrated in the figures, the upper medial side edge and the upper lateral side edge 1772 extend rearwardly from opposite sides of a toe box area 1720 forming, in combination, an upper edge 1774. The length of the upper medial side edge and the upper lateral side edge 1772 define a forefoot opening 1760 in the footwear upper 1710 that opens to the shoe interior 1702.

The toe box area 1720 of the footwear upper 1710 is connected between the upper medial side portion and the upper lateral side portion 1770 and encloses a portion of the shoe interior 1702 adjacent the toe box area 1720. The upper medial side edge and the upper lateral side edge 1772 extend rearwardly from the toe box area 1720.

A plurality of lacing mechanisms 1790 are provided on the upper medial side portion and on the upper lateral side portion 1770. The lacing mechanisms may be an aperture through which a string or lace 1792 is intended to pass. Additional lacing mechanisms are also contemplated such as hooks, loops, integrated fibers/strings, and the like. For example, the lacing mechanisms 1790 may be lacing openings that are typically occupied by a portion of a fastener, such as lacing that close the footwear upper 1710 over the forefoot opening 1760 of the article of footwear 1700. The lacing mechanisms 1790 may be eyelet or grommet style aperture, string or ribbon loops, and the like. The lacing mechanisms 1790 are arranged in lines along the upper medial side portion and the upper lateral side edge 1772, as is conventional. As illustrated in the figures, the lacing mechanisms 1790 may extend substantially the entire length of the upper medial side edge and the upper lateral side edge 1772. However, it is also contemplated that the footwear upper may not comprise forefoot opening 1760, but rather, be enclosed such as in an article of footwear resembling a loafer type construction.

The footwear upper 1710 includes a vamp 1780 or a throat positioned rearwardly of the toe box area 1720, and an optional tongue 1782 may extend rearwardly from the vamp 1780 through the forefoot opening 1760. The optional tongue 1782 may extend along the lengths of the upper medial side portion and the upper lateral side portion 1770 to a distal end of the tongue near an ankle opening 1752. The length and\width of the tongue may position the tongue side edges beneath the upper medial side portion and the upper lateral side portion 1770, and may optionally extend the tongue over the forefoot opening 1760 of the article of footwear 1700.

FIG. 18 displays a close up view 1800 of the region within the circle 18 shown in FIG. 17, for example, post treatment with an external stimulus (e.g. steam at a temperature between 100° C. and 150° C.) to induce a dimensional change in the reactive region 1812 of each woven cell 1810. As shown in FIG. 18, each woven cell 1810 may be separated from adjacent woven cells by perimeter 1820. It is contemplated that prior to treatment with the external stimulus, as described above, the fabric/textile is substantially planar (i.e. flat, with no variable thickness or texture). As seen in FIG. 18, post-treatment, the reactive region 1812 of each woven cell 1810 form protrusions (ridges) that extend a height 1830 above the non-reactive region/perimeters 1820 (valleys,) causing the fabric/textile to become textured. The woven cells such as woven cell 1810 depicted in the exemplary woven materials and footwear constructions in FIGS. 16-17 have been shown as comprising a hexagonal shape. However, it is to be noted that many other stackable shapes may be used, depending on the aesthetics and functionality desired in the final woven product. For example, the shapes shown in FIGS. 12 to 14, square, triangle, and hexagon may also be applicable to these exemplary fabric or textile shown in FIG. 16.

The fabric/textile in FIG. 16 may be woven, the fabric/textile comprising a plurality of discrete woven cells, each woven cell in the plurality of woven cells being separated from a neighboring cell by a perimeter, the perimeter may comprise a single layer construction being formed by interweaving at least a first weft yarn with a warp yarn. Each woven cell may be woven to comprise a reactive region enclosed substantially within the perimeter of each woven cell. As briefly described above, since the perimeter and the non-reactive region of each woven cell are essentially continuous with each other or merging, the non-reactive region enclosed within each woven cell may increase the thickness of the perimeter, for example, by 0% and 100%, 10%, 15%, 20%, 25%, 30%, 35%, 40%, 50%, 55%, 60%, 65%, 70%, 75%, 80%, 85%, 90%, 95%, and the like, and therefore, the area occupied by the reactive region within the perimeter of each woven cell may be proportionately reduced. Therefore, if a gradient is desired, the ratio of reactive region to non-reactive region may be proportionately varied accordingly in order to arrive at the desired gradient. As described previously, the reactive region may comprise a three layer construction with each layer comprising at least one of the first weft yarn, a second weft yarn, or a third weft yarn (see FIG. 7.) The first weft yarn may be comprised of, for example, a polyester yarn, the second weft yarn may be comprised of a thermoplastic coated yarn, and the third weft yarn may be comprised of an elastic yarn, the third yarn being dimensionally unstable when exposed to an external stimulus (e.g. steam). In accordance with aspects herein, the first layer of the reactive region may be formed by interweaving the second weft yarn with the warp yarn, the second layer of the reactive region may comprise mainly the first yarn and be formed by floating the first yarn, and the third layer may be formed by interweaving the third weft yarn with the warp yarn. The non-reactive region, when present, may comprise a single layer construction being formed by interweaving at least the first weft yarn with the warp yarn similar to or in the same manner as the construction of the perimeter. Preferably, the perimeter (and the non-reactive region) may be formed by interweaving all yarns including the first weft yarn, the second weft yarn, the third weft yarn, and the warp yarn.

Further, once formed, the article of footwear shown in FIG. 16 may be further treated with a heat source to further create lock-down or fused sections in, for example the toe area and the heal area of the article of footwear for increased durability and protection. Alternatively, a coating or covering may be applied or otherwise attached to the desired areas for providing increased durability and protection.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different products may be made of the woven material described herein, without departing from the scope thereof, it is to be understood that all matter herein set forth or shown in the accompanying drawings is to be interpreted as illustrative and not in a limiting sense.

Having thus described the invention, what is claimed is:

1. An article of footwear having a woven upper comprising:

a first surface and a second surface; and a plurality of woven cells, each woven cell in the plurality of woven cells comprising:

a reactive region enclosed within a perimeter, wherein the reactive region changes from a first physical state to a second physical state when the woven upper is exposed to an external stimulus, wherein the reactive region is comprised of a first outer layer comprising at least a second weft yarn interwoven with a warp yarn, a second middle layer comprising at least a first weft yarn, and a third outer layer comprising at least a third weft yarn interwoven with the warp yarn, wherein the third weft yarn is dimensionally unstable in response to the external stimulus, wherein the second middle layer is between the first outer layer and the third outer layer, and wherein the first surface of the woven upper is comprised of the first outer layer and the second surface of the woven upper is comprised of the third outer layer.

2. The article of footwear of claim 1, wherein a first woven cell and a second woven cell in the plurality of woven cells have at least one common portion of the perimeter.

3. The article of footwear of claim 1, wherein the third weft yarn is interwoven with at least a portion of the first weft yarn and at least a portion of the second weft yarn at the perimeter.

4. The article of footwear of claim 1, wherein the warp yarn is a 50 denier-600 denier polyester yarn.

5. The article of footwear of claim 1, wherein the first weft yarn, the second weft yarn, and the warp yarn are dimensionally stable in response to the external stimulus.

6. The article of footwear of claim 1, wherein a length of the third weft yarn is dimensionally reduced in response to the external stimulus.

7. The article of footwear of claim 6, wherein the first weft yarn limits elongation of the reactive region in a weft direction.

8. The article of footwear of claim 1, wherein the reactive region abuts at least a portion of the perimeter.

9. The article of footwear of claim 1, wherein the external stimulus comprises moisture that is at or above 100 degrees Celsius and at or below 150 degrees Celsius.

10. The article of footwear of claim 1, wherein the each woven cell in the plurality of woven cells further comprises a non-reactive region enclosed within the reactive region.

11. A method for manufacturing a footwear upper, the method comprising:

weaving a roll of a woven material, the woven material comprising:

a first surface and a second surface; and a plurality of woven cells, each woven cell in the plurality of woven cells comprising:

a perimeter comprising at least a first weft yarn; and a reactive region enclosed within the perimeter, wherein the reactive region changes from a first physical state to a second physical state when the woven material is exposed to an external stimulus, wherein the reactive region is comprised of a first outer layer having at least a second weft yarn interwoven with a warp yarn, a second middle layer having at least the first weft yarn, and a third outer layer having at least a third weft yarn interwoven with the warp yarn, wherein the third weft yarn is dimensionally unstable in response to the external stimulus, wherein the second middle layer is between the first outer layer and the third outer layer, and wherein the first surface of the woven material is comprised of the first outer layer and the second surface of the woven material is comprised of the third outer layer;

cutting at least one upper form from the woven material; and forming the footwear upper from the at least one upper form.

12. The method of claim 11 further comprising exposing the woven material to the external stimulus prior to cutting the at least one upper form from the woven material.

13. The method of claim 11 further comprising exposing the woven material to the external stimulus after cutting the at least one upper form from the woven material.

14. The method of claim 11, wherein the each woven cell in the plurality of woven cells further comprises a non-reactive region enclosed within the reactive region.

15. The method of claim 11, wherein the external stimulus comprises moisture that is at or above 100 degrees Celsius and at or below 150 degrees Celsius.

16. The method of claim 11, wherein the warp yarn is a 50 denier-600 denier polyester yarn.

17. The method of claim 11, wherein the first weft yarn, the second weft yarn, and the warp yarn are dimensionally stable in response to the external stimulus.

* * * * *